US012760646B2

(12) United States Patent
Morisawa et al.

(10) Patent No.: US 12,760,646 B2
(45) Date of Patent: Oct. 13, 2026

(54) WATER BOTTOM RESOURCE COLLECTING METHOD

(71) Applicants: TOA CORPORATION, Tokyo (JP); JAPAN AGENCY FOR MARINE-EARTH SCIENCE AND TECHNOLOGY, Yokosuka (JP)

(72) Inventors: Tomohiro Morisawa, Tokyo (JP); Shinya Omori, Tokyo (JP); Yosuke Tanaka, Tokyo (JP); Eigo Miyazaki, Yokosuka (JP); Keita Akiyama, Yokosuke (JP); Masanori Kyo, Yokosuka (JP); Ikuo Sawada, Yokosuka (JP); Yoshihisa Kawamura, Yokosuka (JP)

(73) Assignees: TOA CORPORATION, Tokyo (JP); JAPAN AGENCY FOR MARINE-EARTH SCIENCE AND TECHNOLOGY, Yokosuka (JP)

( * ) Notice: Subject to any disclaimer, the term of this patent is extended or adjusted under 35 U.S.C. 154(b) by 327 days.

(21) Appl. No.: 18/280,106

(22) PCT Filed: Feb. 8, 2022

(86) PCT No.: PCT/JP2022/004960
§ 371 (c)(1),
(2) Date: Sep. 1, 2023

(87) PCT Pub. No.: WO2022/185861
PCT Pub. Date: Sep. 9, 2022

(65) Prior Publication Data

US 2024/0003253 A1 Jan. 4, 2024

(30) Foreign Application Priority Data

Mar. 4, 2021 (JP) ..... 2021-034372
Mar. 4, 2021 (JP) ..... 2021-034373

(51) Int. Cl.
*E21C 50/00* (2006.01)

(52) U.S. Cl.
CPC ..... *E21C 50/00* (2013.01)

(58) Field of Classification Search
CPC ..... E21C 50/00
(Continued)

(56) References Cited

U.S. PATENT DOCUMENTS 5,480,291 A 1/1996 Sills
5,713,422 A * 2/1998 Dhindsa ..... E21B 19/084 173/4
12,084,948 B2 9/2024 Miyazaki et al.

FOREIGN PATENT DOCUMENTS

CN 108265765 * 7/2018
CN 108265766 A 7/2018
(Continued)

OTHER PUBLICATIONS

Office Action dated Dec. 4, 2025 issued in the corresponding Chinese Application No. 202280016280.

*Primary Examiner* — Muhammad Shafi
(74) *Attorney, Agent, or Firm* — XSENSUS LLP

(57) ABSTRACT

A mining riser pipe is extended toward a water bottom, and a lower portion of an insertion pipe connected to a lower portion of the mining riser pipe is inserted into the water bottom. A liquid is supplied into the insertion pipe, and a rotation shaft extends inside both pipes and stirring blades attached to a lower portion of the rotation shaft are rotated inside the insertion pipe, thereby drilling and dissolving mud inside the insertion pipe into a slurry. Then, the mud S is raised to an upper portion of the insertion pipe by a stirring flow generated by the stirring blades, and the raised mud slurry is lifted above the water through the mining riser pipe 2, and a rotation speed of the stirring blades is lower in an
(Continued)

initial process at an early stage of the drilling than in a subsequent process.

10 Claims, 18 Drawing Sheets

(58) Field of Classification Search
USPC ..... 37/307
See application file for complete search history.

(56) References Cited

FOREIGN PATENT DOCUMENTS

| | | | | |
|---|---|---|---|---|
| CN | 111379516 | A | | 7/2020 |
| JP | H02-248535 | A | | 10/1990 |
| JP | H-02248535 | | * | 10/1990 |
| JP | 2002-364018 | A | | 12/2002 |
| JP | 2002364018 | | * | 12/2002 |
| JP | 2006-198476 | A | | 8/2006 |
| JP | 2007255064 | A | | 10/2007 |
| JP | 2016-176314 | A | | 10/2016 |
| JP | 2019-011568 | A | | 1/2019 |
| JP | 2020-002627 | A | | 1/2020 |
| JP | 6653890 | B2 | | 2/2020 |
| JP | 6739022 | B2 | | 8/2020 |
| JP | 6774079 | B1 | | 10/2020 |

* cited by examiner

WATER BOTTOM RESOURCE COLLECTING METHOD

TECHNICAL FIELD

The present invention relates to a water bottom resource collecting method, and more specifically relates to a water bottom resource collecting method that is capable of efficiently collecting water bottom resources contained in mud of a water bottom.

BACKGROUND ART

In marine resource developments, sediments of water bottoms containing water bottom resources such as rare earths present in deep sea are lifted together with a liquid such as water on offshore vessels on the water and the like by utilizing lifting means such as a pump lift or an airlift. As a soil mass of mud is larger, a larger amount of the liquid is required for lifting. As the amount of the liquid lifted together with mud increases, the lifting work or the man-hour for separating the mud and the liquid increases, and the cost required for collecting water bottom resources also increases. Therefore, in order to efficiently collect water bottom resources contained in sediments of water bottoms, it is important to finely dissolve sediments of water bottoms and lift the mud with a smaller amount of the liquid.

Various systems for drilling and lifting sediments of water bottoms have conventionally been proposed (see Patent Document 1). In a marine resource ore lifting apparatus of Patent Document 1, a collecting hopper provided on a lower portion of a mining riser pipe portion is set to face the surface of a water bottom. Subsequently, a bit being rotated is caused to penetrate into the water bottom and an emulsion (an oil mixed with a surfactant) having a smaller specific gravity than that of salt water is jetted from a nozzle provided on a lower end portion of the bit to drill mud of a water bottom. Then, the mud and the emulsion raised from the inside of the water bottom to an upper portion of the collecting hopper are lifted above the water through the mining riser pipe portion. In this method, since a large part of mud in a water bottom drilled by the bit disperses in the water bottom, the mud cannot be finely dissolved. For this reason, in this marine resource ore lifting apparatus, the emulsion having a smaller specific gravity than that of salt water is jetted into the water bottom in order to raise the mud. However, since it is necessary to jet a large amount of the emulsion into the water bottom for lifting, the man-hour for separating the lifted mud and the emulsion increases, and the cost required for collecting water bottom resources increases. In addition, there is also a concern that the underwater environment is damaged by the emulsion flowing out into the water.

PRIOR ART DOCUMENT

Patent Document

Patent Document 1: Japanese patent application Kokai publication No. 2019-11568

SUMMARY OF THE INVENTION

Problem to be Solved by the Invention

An object of the present invention is to provide a water bottom resource collecting method that is capable of efficiently collecting water bottom resources contained in mud of a water bottom.

Means for Solving the Problem

In order to achieve the above-described object, a water bottom resource collecting method of the present invention is a water bottom resource collecting method for drilling mud of a water bottom in an undrilled state which contains water bottom resources and lifting the mud above water, characterized in that the water bottom resource collecting method comprises: in a state where a mining riser pipe is extended from above the water toward the water bottom and at least a lower portion of an insertion pipe connected to a lower portion of the mining riser pipe is inserted in the water bottom, supplying a liquid into the insertion pipe and rotating a rotation shaft that extends inside the mining riser pipe and the insertion pipe in a pipe axial direction and a stirring blade attached to a lower portion of the rotation shaft inside the insertion pipe, thereby drilling and dissolving the mud inside the insertion pipe by using the stirring blade; raising the mud turned into a slurry form by the dissolving to an upper portion of the insertion pipe by using a stirring flow generated by the rotation of the stirring blade; and lifting the raised mud in the slurry form above the water through the mining riser pipe by using lifting means, wherein a rotation speed of the stirring blade is lower in an initial process at an early stage of drilling than in a subsequent process after the initial process.

Effects of the Invention

According to the present invention, in the subsequent process after the initial process, the mud inside the insertion pipe is drilled and dissolved by the stirring blade being rotated at a higher speed, making it possible to efficiently break the mud inside the insertion pipe into finer grains in a slurry form. Moreover, by rotating the stirring blade at a higher speed, a stirring flow which allows the mud broken into finer grains to easily rise can be generated inside the insertion pipe. On the other hand, in the initial process at the early stage of drilling, the stirring blade is rotated at a lower speed, making it possible to reduce the risk that the mud which has large soil masses rises to the upper portion of the insertion pipe and the mining riser pipe is clogged with the mud. Therefore, it is possible to efficiently lift the mud of the water bottom with a relatively small amount of the liquid, and thus to efficiently collect water bottom resources contained in the mud.

MODES FOR CARRYING OUT THE INVENTION

Figure 1:
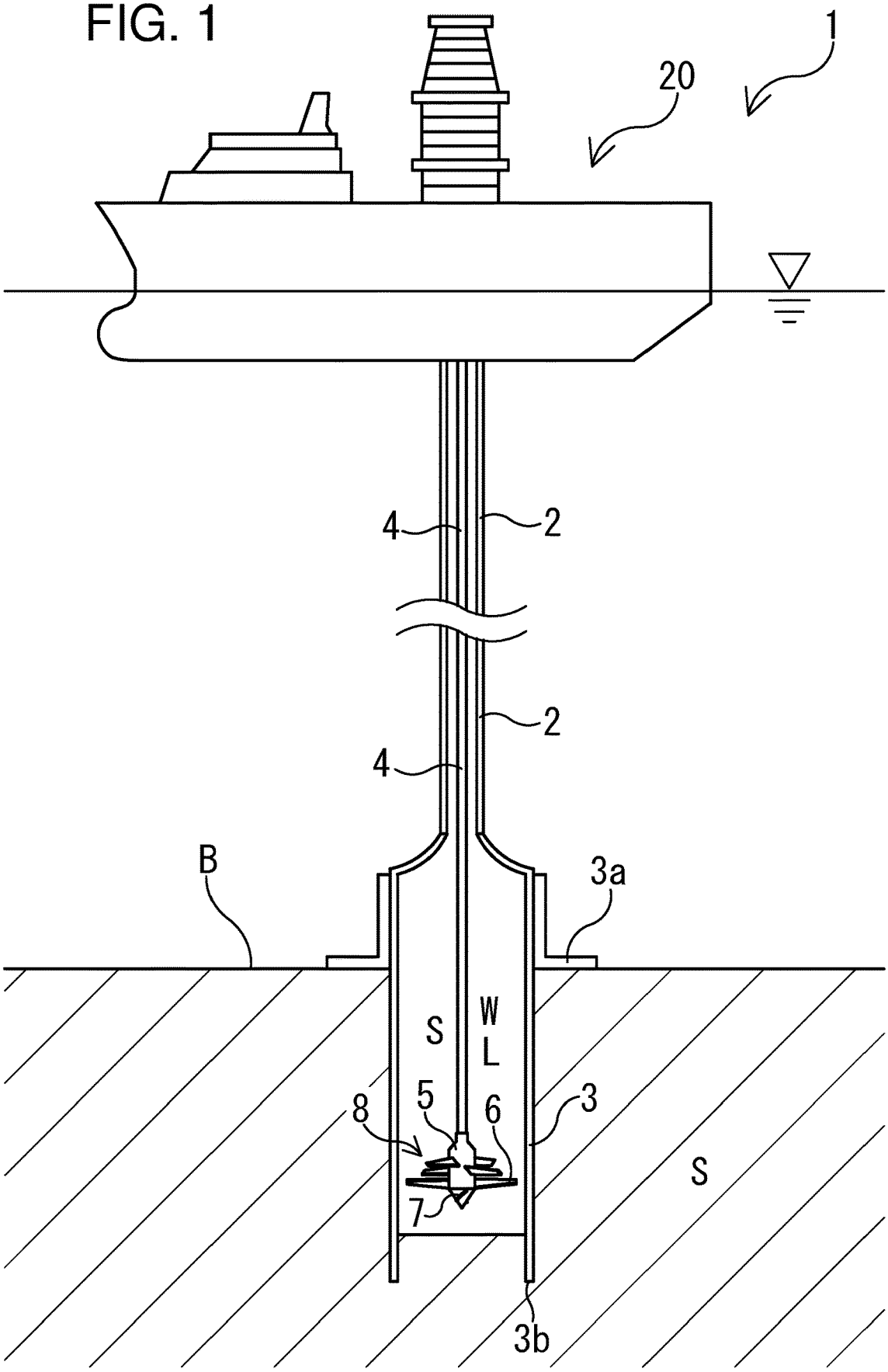
FIG. 1 is an explanatory diagram illustrating an outline of an embodiment of a water bottom resource collecting method of the present invention.

Hereinafter, a water bottom resource collecting method of the present invention will be described based on embodiments shown in the drawings. In the present invention, mud S of a water bottom B in the undrilled state which contains water bottom resources (mineral resources) such as rare earths is drilled and lifted above water by using a water bottom resource collecting system 1 illustrated in FIG. 1 (hereinafter, referred to as the collecting system 1).

The collecting system 1 includes: a mining riser pipe 2 that extends from above water toward a water bottom B; an insertion pipe 3 that is connected to a lower portion of the mining riser pipe 2; and a rotation shaft 4 that extends inside the mining riser pipe 2 and the insertion pipe 3 in a pipe axial direction. The collecting system 1 further includes: stirring blades 6 that are attached to a lower portion of the rotation shaft 4; and a liquid supply mechanism 8 that supplies a liquid L (salt water or fresh water) into the insertion pipe 3. Although this embodiment illustrates a case where the mining riser pipe 2 is connected to a offshore vessel 20 on the water, for example, a configuration in which the mining riser pipe 2 is connected to not the offshore vessel 20 but a lifting facility provided on the water, or the like, is also possible.

The mining riser pipe 2 and the insertion pipe 3 communicate with each other. The inner diameter of the insertion pipe 3 is set to be larger than the inner diameter of the mining riser pipe 2. An inner peripheral surface of a coupling portion of the mining riser pipe 2 and the insertion pipe 3 has a smoothly continuous curved surface shape. The inner diameter of the mining riser pipe 2 is set, for example, within a range of 0.2 m or more and 1.0 m or less, and the inner diameter of the insertion pipe 3 is set, for example, within a range of 0.5 m or more and 5 m or less. To the mining riser pipe 2, lifting and sending means for lifting and sending mud S which has risen to an upper portion of the insertion pipe 3 above the water through the mining riser pipe 2 is connected. The lifting and sending means includes, for example, an airlift pump, a slurry pump, or the like.

The length of the insertion pipe 3 in the pipe axial direction is set as appropriate in accordance with the depth of a stratum where water bottom resources are distributed, but is set, for example, within a range of 2 m or more and 20 m or less. In this embodiment, a stopper 3*a* having an annular shape in plan view is provided on an outer peripheral surface of the insertion pipe 3. With this stopper 3*a* serving as a boundary, a region of the insertion pipe 3 below the stopper 3*a* is inserted into the water bottom B, and a region of the insertion pipe 3 above the stopper 3*a* protrudes above the surface of the water bottom B.

Figure 2:
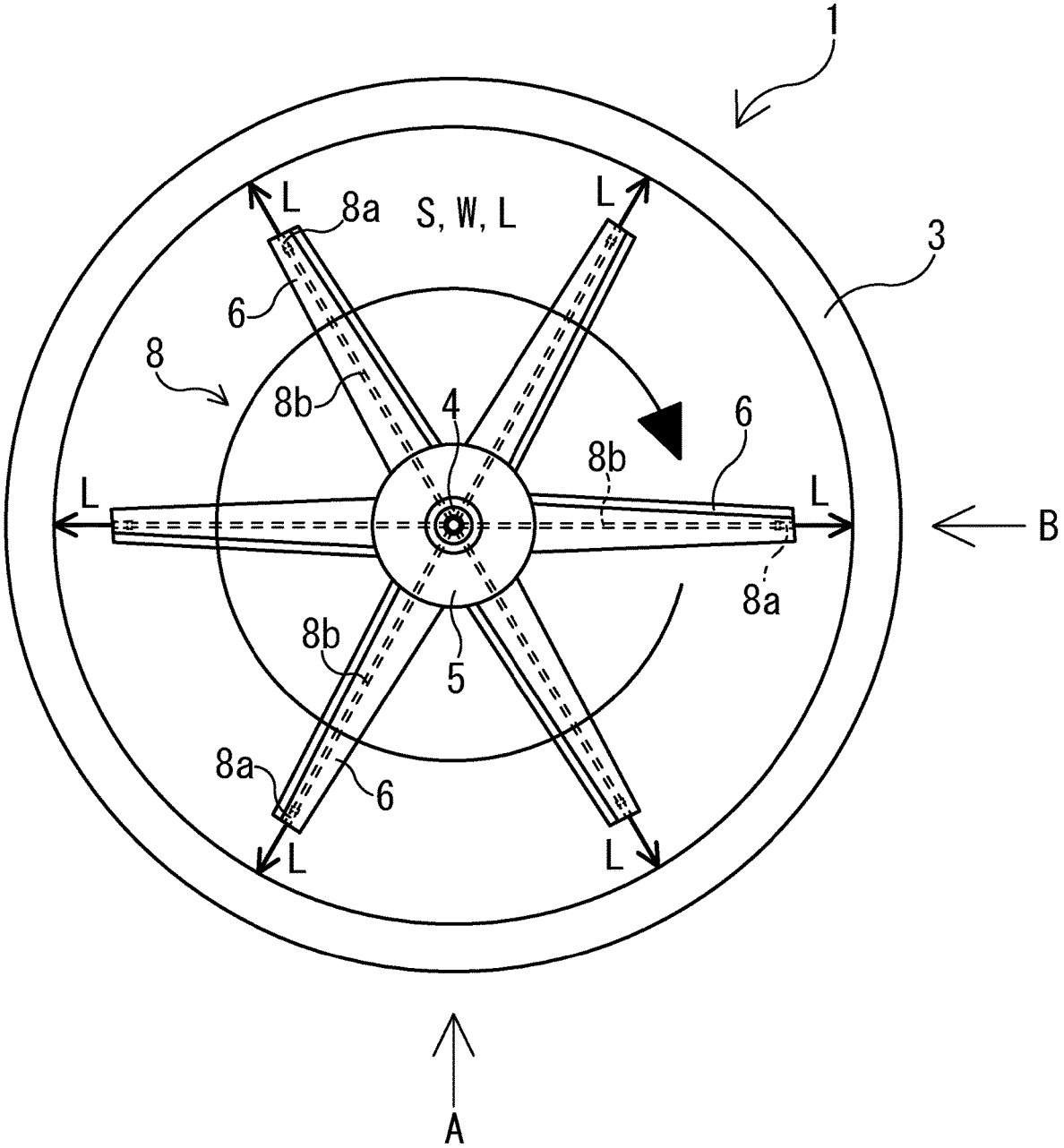
FIG. 2 is an explanatory diagram illustrating an inside of an insertion pipe of FIG. 1 in plan view.
Figure 3:
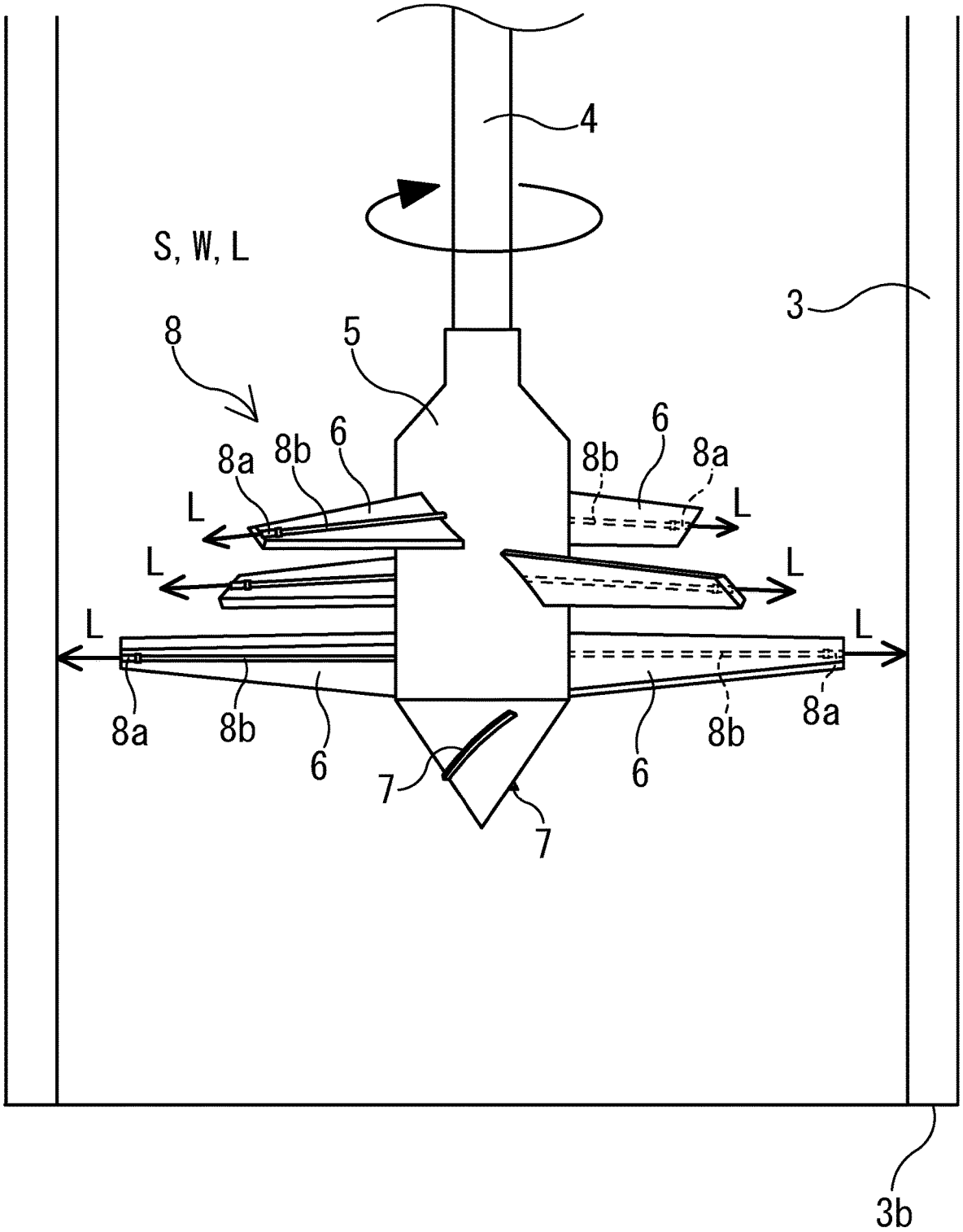
FIG. 3 is an explanatory diagram illustrating the inside of the insertion pipe as viewed in the direction of arrow A of FIG. 2.
Figure 4:
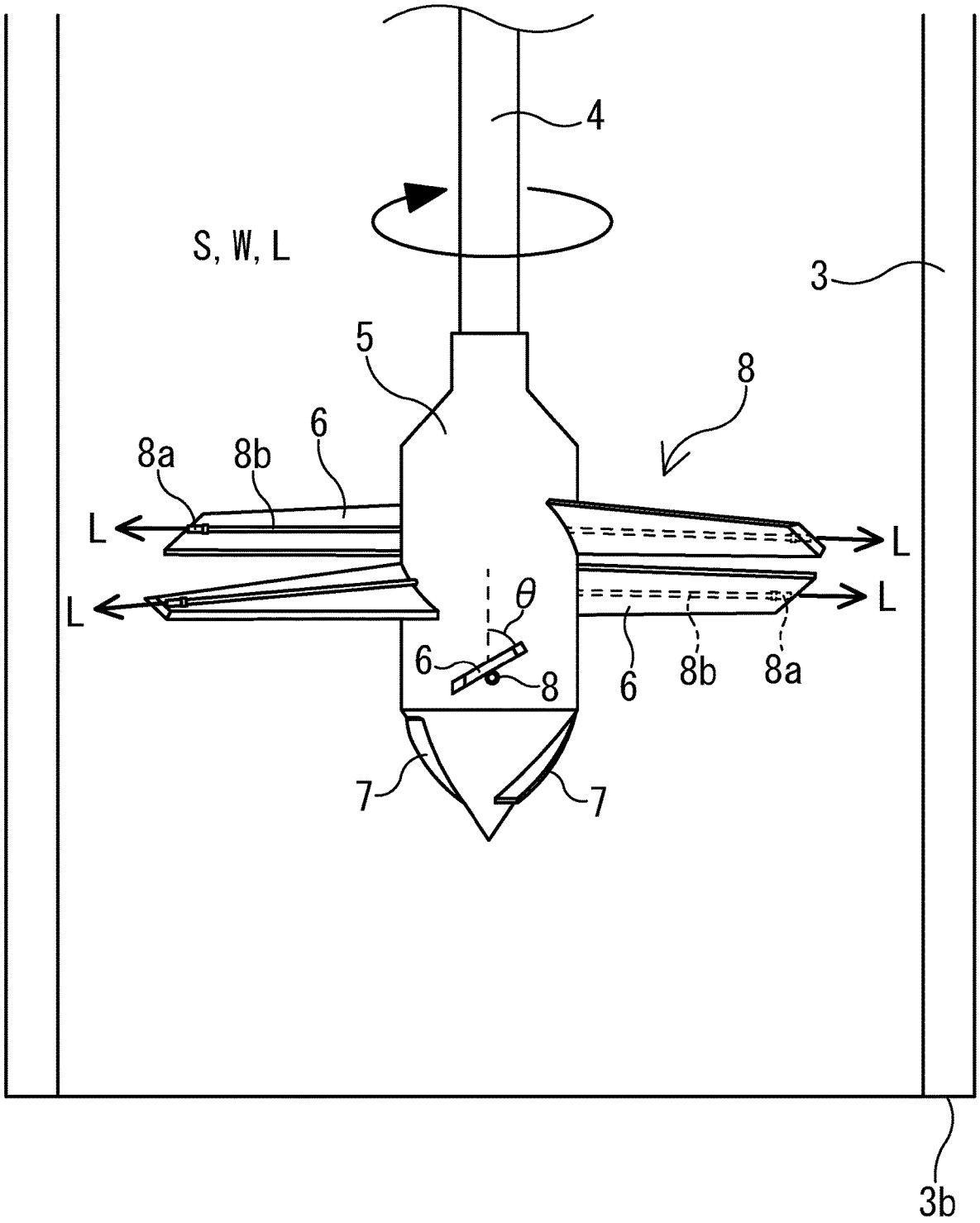
FIG. 4 is an explanatory diagram illustrating the inside of the insertion pipe as viewed in the direction of arrow B of FIG. 2.

The rotation shaft 4 is hung from the offshore vessel 20 and inserted through the mining riser pipe 2 and the insertion pipe 3, and is axially rotated by a drive mechanism. As illustrated in FIG. 2 to FIG. 4, in this embodiment, the stirring blades 6 are attached to a head 5 detachably coupled to a lower portion of the rotation shaft 4. On a lower end portion of the head 5, a drill blade 7 for drilling the mud S of the water bottom B is provided. On an outer peripheral surface of the head 5 located above the drill blade 7, stirring blade groups each including a plurality of the stirring blades 6 are provided. Each stirring blade 6 extends toward an inner peripheral surface of the insertion pipe 3. The plurality of stirring blades 6 included in the same stirring blade group are arranged at intervals in a circumferential direction of the rotation shaft 4.

Each stirring blade 6 of this embodiment is formed into a flat plate shape, and has a tapered shape which becomes thinner as extending from a base portion connected to the rotation shaft 4 (the head 5) toward a tip end. A front end portion of each stirring blade 6 in a rotational direction has a sharply pointed shape. For example, the front end portion of each stirring blade 6 may be formed into a sawtooth shape in which mountains and valleys continue. The shape of each stirring blade 6 is not limited to a flat plate shape but may be, for example, a curved shape like a screw blade.

In this embodiment, stirring blade groups each including two stirring blades 6 arranged at opposite positions are provided at three stages in an axial direction of the rotation shaft 4. Each of the stirring blades 6 included in the stirring blade group at the lowermost stage is inclined downward toward the rotational direction. Each of the stirring blades 6 included in each of the stirring blade group at the middle stage and the stirring blade group at the uppermost stage is inclined upward toward the rotational direction. As illustrated in FIG. 4, the angle θ (depression) made by the axial direction of the rotation shaft 4 and the extension direction of each stirring blade 6 is set, for example, within a range of 10 degrees or more and 80 degrees or less, preferably 20 degrees or more and 70 degrees or less, and more preferably 25 degrees or more and 40 degrees or less.

Stirring blades 6 adjacent to each other in the axial direction of the rotation shaft 4 are arranged at positions shifted in the circumferential direction of the rotation shaft 4 in plan view. Between the inner peripheral surface of the insertion pipe 3 and the tip end of each stirring blade 6, a gap (clearance) of around 50 mm to 500 mm is provided.

The number of stages of the stirring blade groups provided in the axial direction of the rotation shaft 4, the number of the stirring blades 6 included in the stirring blade group at each stage, and the like are not limited to this embodiment, and may have a different configuration. For example, a configuration in which stirring blade groups each including three stirring blades 6 are provided at two stages in the axial direction of the rotation shaft 4, or the like is possible. It is preferable that the stirring blades 6 included in each stirring blade group be arranged to be point-symmetrical about the axis of the rotation shaft 4 in plan view. The direction of inclination of each stirring blade 6 included in the stirring blade group at each stage is not limited to this embodiment, and for example, a configuration in which the stirring blades 6 included in the stirring blade group at the uppermost stage or the stirring blade group at the middle stage are inclined downward toward the rotational direction is also possible.

The liquid supply mechanism 8 supplies, for example, water (salt water or fresh water) as the liquid L. It is convenient to utilize field site water (salt water or fresh water) available at a field site. Besides, for example, a configuration in which a liquid obtained by adding additives to water or a liquid other than water is supplied as the liquid L is also possible. The liquid supply mechanism 8 of this embodiment has jet nozzles 8*a* provided at the tip end portions of the stirring blades 6. A liquid supply apparatus set above the water (on the offshore vessel 20) supplies the liquid L to each of the jet nozzles 8*a* through a main pipe extending inside the rotation shaft 4 and a plurality of pipes 8*b* branched from the main pipe at a lower portion thereof.

The jet nozzles 8*a* and the pipes 8*b* are provided in surfaces on the back sides of the stirring blades 6 in the rotational direction of the stirring blades 6. For example, a configuration in which the jet nozzles 8*a* and the pipes 8*b* are provided inside the stirring blades 6 to jet the liquid L from the tip ends of the stirring blades 6 is also possible. Although in this embodiment, the jet nozzles 8*a* are provided for all the stirring blades 6, respectively, the jet nozzles 8*a* may be provided selectively for some of the stirring blades 6. That is, for example, the jet nozzles 8*a* may be provided only in the respective stirring blades 6 included in the stirring blade group at the lowermost stage.

In the case where the jet nozzles 8*a* are provided selectively for some of the stirring blades 6 as well, it is preferable that the jet nozzles 8*a* provided at each stage be arranged to be point-symmetrical about the axis of the rotation shaft 4 in plan view. Note that the liquid supply mechanism 8 only has to have a configuration that can supply the liquid L into the insertion pipe 3, and is not limited to the configuration of this embodiment.

Next, an example of the procedure of the method for collecting water bottom resources by using this collecting system 1 will be described below. In the present invention, an initial process and a subsequent process are conducted.

Figure 5:
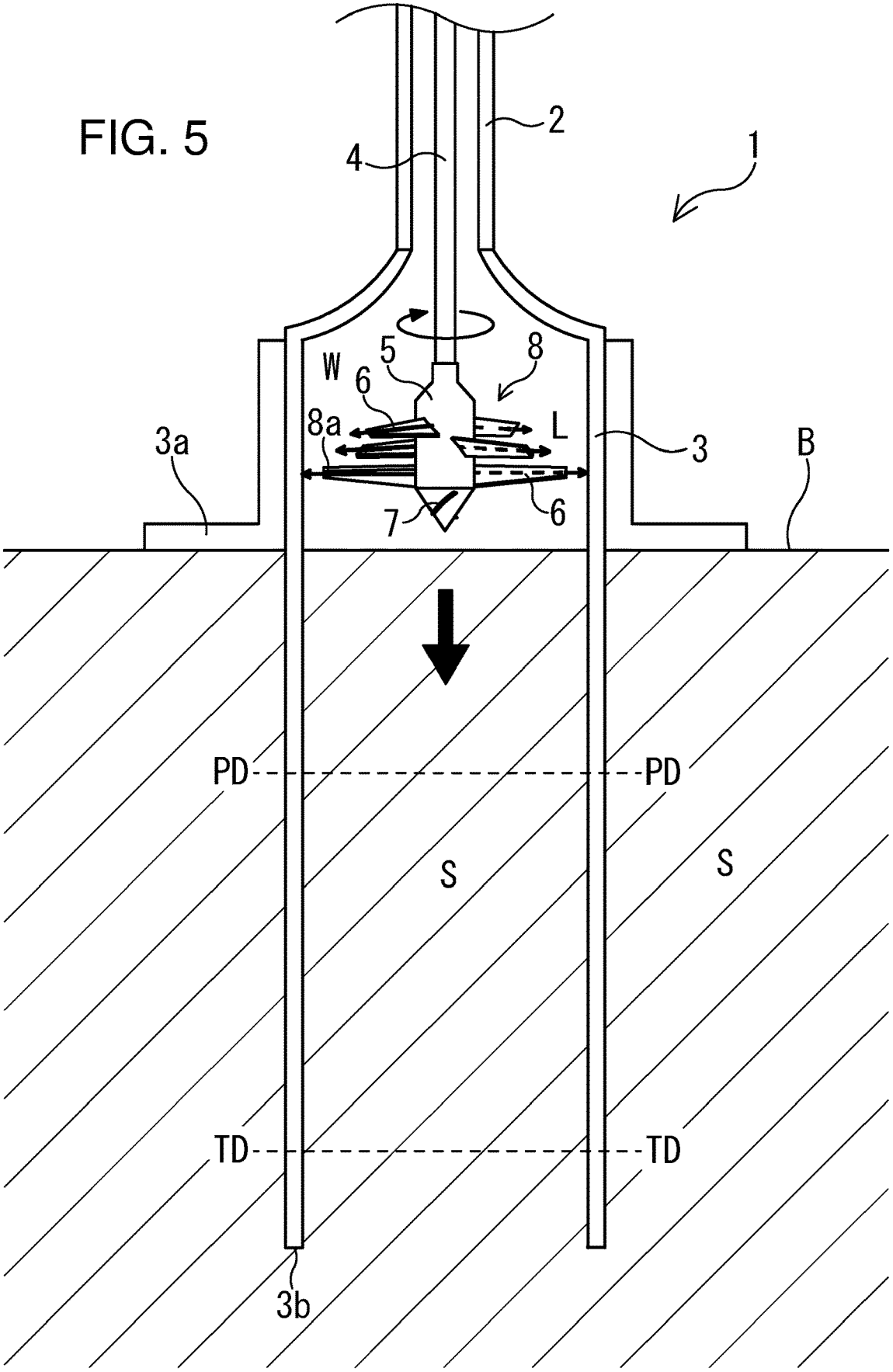
FIG. 5 is an explanatory diagram illustrating a state where the insertion pipe of FIG. 1 is inserted in a water bottom.

The insertion pipe 3 is connected to the lower portion of the mining riser pipe 2, and the head 5 is detachably fixed inside the upper portion of the insertion pipe 3. In the initial process, as illustrated in FIG. 5, the mining riser pipe 2 is extended from above the water (the offshore vessel 20) toward the water bottom B, and at least the lower portion of the insertion pipe 3 is inserted into the water bottom B in the undrilled state. For example, 50% or more of the entire length of the insertion pipe 3 is inserted into the water bottom B. The upper portion of the insertion pipe 3 in which the head 5 is housed is not inserted into the water bottom B, so that the head 5 is disposed above the surface of the water bottom B. At this stage, the inside of the lower portion of the insertion pipe 3, which is inserted in the water bottom B, is in the state of being filled with the mud S of the water bottom B. The inside of the upper portion of the insertion pipe 3, which is not inserted in the water bottom B, is in the state of being filled with water W of the water area.

In this embodiment, when the insertion pipe 3 is inserted into the water bottom B to a position where the stopper 3*a* provided on the outer side of the insertion pipe 3 abuts on the surface of the water bottom B, the lower portion of the insertion pipe 3 is inserted to a depth of the stratum where water bottom resources are distributed. The upper portion of the insertion pipe 3 in which the head 5 is housed is in the state of protruding above the surface of the water bottom B.

Subsequently, in the state of being inserted through the insides of the mining riser pipe 2 and the insertion pipe 3, the rotation shaft 4 is sent down from above the water (the offshore vessel 20) toward the water bottom B, and the head 5 (the stirring blades 6) is coupled to the lower end portion of the rotation shaft 4. In the state in which the head 5 is coupled to the lower end portion of the rotation shaft 4, when the rotation shaft 4 is further moved downward toward the water bottom B, the head 5 is detached from the insertion pipe 3. As a result, the head 5 (the stirring blades 6) integrated with the rotation shaft 4 is brought into the state of being capable of moving in the pipe axial direction.

Figure 6:
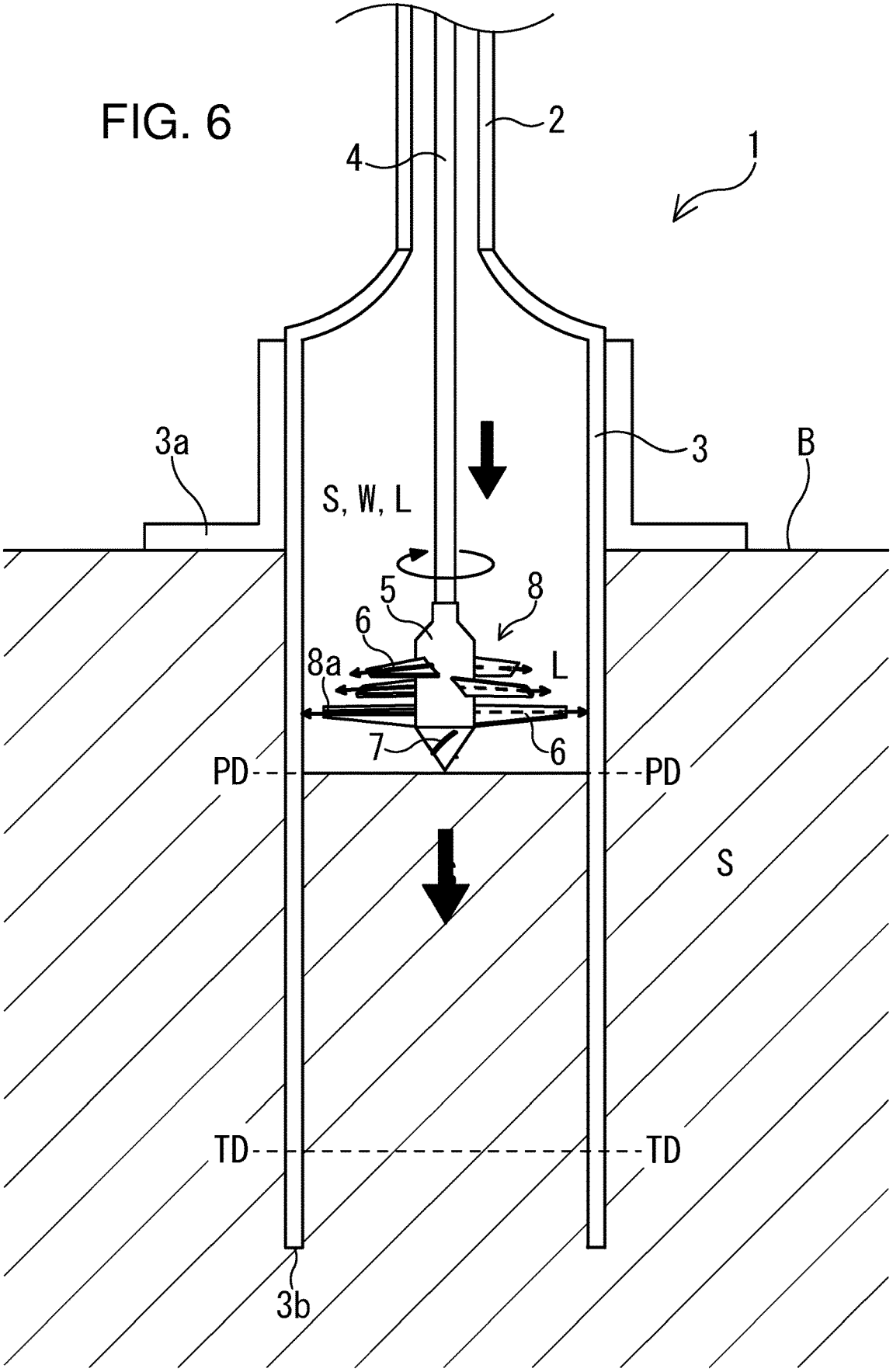
FIG. 6 is an explanatory diagram illustrating a state where stirring blades being rotated at a lower speed are caused to penetrate into a predetermined depth that is shallower than a target depth of the water bottom from the state of FIG. 5.

Subsequently, as illustrated in FIG. 6, the liquid L is supplied into the insertion pipe 3 by the liquid supply mechanism 8 and the stirring blades 6 being rotated inside the insertion pipe 3 are caused to penetrate from the surface of the water bottom B in an undrilled state into the water bottom B, thereby drilling and dissolving the mud S inside the insertion pipe 3. In the initial process at the early stage of the drilling, the rotation speed of the stirring blades 6 is set to be lower than that in the subsequent process after this initial process. The rotation speed (revolution per minute) of the stirring blades 6 in the initial process is set, for example, within a range of 5 rpm to 20 rpm.

Figure 7:
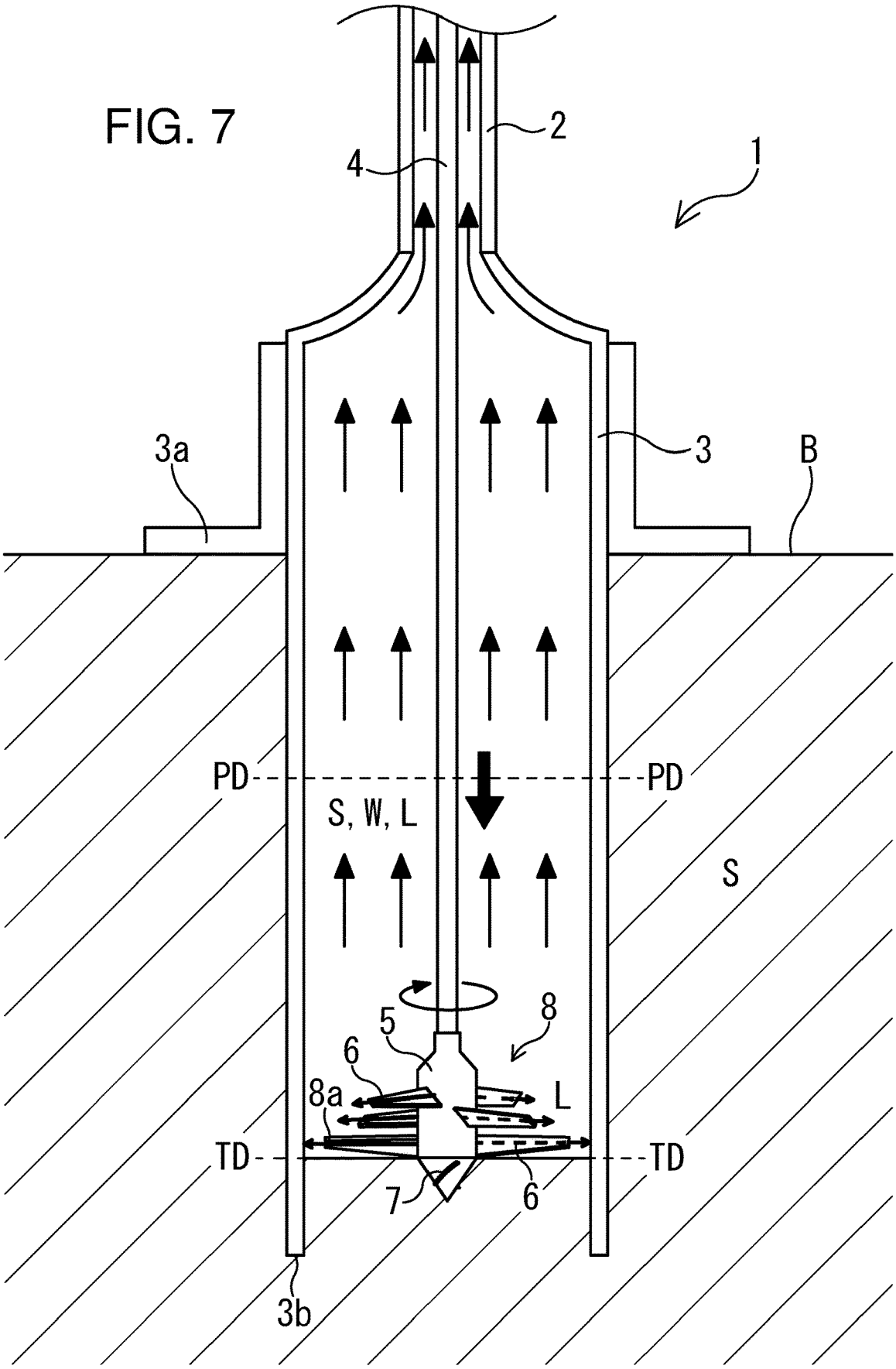
FIG. 7 is an explanatory diagram illustrating a state where the stirring blades being rotated at a higher speed are caused to penetrate into the target depth of the water bottom from the state of FIG. 6.

Subsequently, in the subsequent process, as illustrated in FIG. 7, the liquid L is supplied into the insertion pipe 3 by the liquid supply mechanism 8, and the mud S inside the insertion pipe 3 is drilled and dissolved by the stirring blades 6 having a rotation speed set to be higher than that in the initial process. Then, the mud S turned into a slurry form by the dissolving is raised to an upper portion of the insertion pipe 3 by a stirring flow generated by the rotation of the stirring blades 6, and the raised mud S in the slurry form is lifted above the water through the mining riser pipe 2 by lifting means.

The rotation speed of the stirring blades 6 in the subsequent process is set, for example, to a rotation speed 1.5 to 4.0 times the rotation speed of the stirring blades 6 in the initial process. Specifically, since it is necessary to make the rotation speed of the stirring blades 6 high to a certain degree in order to generate the stirring flow which raises the mud S, the rotation speed (revolution per minute) of the stirring blades 6 in the subsequent process may be set to 20 rpm or more, more preferably 30 rpm or more, and further preferably 40 rpm or more. On the other hand, since there is a limitation on rotating the stirring blades 6 at a high speed, the upper limit of the rotation speed is set, for example, to 80 rpm, or around 60 rpm. Note that in each of the initial process and the subsequent process, the rotation speed of the stirring blades 6 is not necessarily constant throughout the entire period of the process, and in the case where the rotation speed is not constant, an average rotation speed is calculated. Then, the rotation speed in the subsequent process is set to be 1.5 to 4.0 times that in the initial process by using the calculated average rotation speed.

In this embodiment, the mud S between the tip ends of the stirring blades 6 and the inner peripheral surface of the insertion pipe 3 is drilled and dissolved by jetting the liquid L from the jet nozzles 8*a* toward the inner peripheral surface of the insertion pipe 3 at high pressure. As illustrated in FIG. 6, in the initial process in which the rotation speed of the stirring blades 6 is made lower, the stirring blades 6 are caused to penetrate from the surface of the water bottom B in the undrilled state to a predetermined depth PD which is shallower than a target depth TD of the water bottom B to drill and dissolve the mud S up to the predetermined depth PD inside the insertion pipe 3.

The target depth TD may be set as appropriate in accordance with the depth of the stratum where water bottom resources are distributed, but is set, for example, to a depth of around 1.5 m to 9 m from the surface of the water bottom B. The target depth TD is set to a depth of an intermediate position in the insertion pipe 3 in the state of being inserted into the water bottom B. The predetermined depth PD may be set as appropriate in accordance with the hardness of the mud S of the water bottom B, but is set, for example, to a depth of around 0.5 m to 2 m from the surface of the water bottom B, or within a depth range of 20% to 60% of the target depth TD from the surface of the water bottom B.

In the subsequent process in which the rotation speed of the stirring blades 6 is made higher, the stirring blades 6 are caused to penetrate from the predetermined depth PD to the target depth TD to drill and dissolve the mud S from the predetermined depth PD to the target depth TD inside the insertion pipe 3. The mud S dissolved in the initial process is stirred together with the mud S drilled and dissolved in the subsequent process inside the insertion pipe 3 by the stirring flow generated by the high-speed rotation of the stirring blades 6 to be more finely dissolved. The mud S broken into finer grains inside the insertion pipe 3 is mixed with and floated in the liquid inside the insertion pipe 3 (including the water W of the water area and the liquid L supplied by the liquid supply mechanism 8), and the inside of the insertion pipe 3 is filled with the mud S in the slurry form.

Then, by newly supplying the liquid L into the insertion pipe 3 by the liquid supply mechanism 8 (the jet nozzles 8*a*), the replacement of the water W and the mud S inside the insertion pipe 3 with the newly supplied liquid L is promoted. Moreover, the mud S in the slurry form which has raised to the upper portion of the insertion pipe 3 by the stirring flow generated by the high-speed rotation of the stirring blades 6 is serially lifted above the water (on the offshore vessel 20) through the mining riser pipe 2 by the lifting means.

In this way, in the present invention, in the initial process at the early stage of drilling, the stirring blades 6 are rotated at a lower speed, making it possible to reduce the risk that the mud S which has not been sufficiently dissolved and has large soil masses rises to the upper portion of the insertion pipe 3 and the mining riser pipe 2 is clogged with the mud S. On the other hand, in the subsequent process, the mud S inside the insertion pipe 3 is drilled and dissolved by the stirring blades 6 being rotated at a higher speed, making it possible to efficiently break the mud S inside the insertion pipe 3 into finer grains in a slurry form. Moreover, by rotating the stirring blades 6 at a higher speed, the stirring flow which allows the mud S broken into finer grains to easily rise can be generated inside the insertion pipe 3. Therefore, it is possible to efficiently lift the mud S of the water bottom B with a relatively small amount of the liquid, and thus to efficiently collect water bottom resources contained in the mud S.

When the mud S at a relatively shallow depth is drilled and dissolved, the amount of the mud S that is retained in the upper portion is relatively small, so that the mud S drilled and dissolved by the stirring blades 6 relatively easily rises. Hence, when the stirring blades 6 having a rotation speed made lower are caused to penetrate from the surface of the water bottom B in the undrilled state to the predetermined depth PD which is shallower than the target depth TD in the initial process like this embodiment, it is possible to reduce the risk that the mud S at a shallow depth rises to the upper portion of the insertion pipe 3 in the state of having large soil masses and the mining riser pipe 2 is clogged with the mud S.

After the stirring blades 6 are caused to penetrate to the predetermined depth PD, the amount of the mud S which is retained above the stirring blades 6 becomes relatively large, so that the possibility that the mud S rises to the upper portion of the insertion pipe 3 in the state of having large soil masses becomes low. Therefore, in the subsequent process, it is possible to efficiently drill and dissolve the mud S inside the insertion pipe 3 by causing the stirring blades 6 having a rotation speed made higher to penetrate from the predetermined depth PD to the target depth TD. Moreover, the mud S in the slurry form can be efficiently raised to the upper portion of the insertion pipe 3 by generating the stirring flow flowing at a high speed inside the insertion pipe 3 by rotating the stirring blades 6 at a high speed.

Next, another example of the procedure of the method for collecting water bottom resources will be described below. The procedure from inserting the insertion pipe 3 into the water bottom B in the undrilled state and coupling the head 5 (the stirring blades 6) to the lower end portion of the rotation shaft 4 is the same as the procedure previously illustrated.

Figure 8:
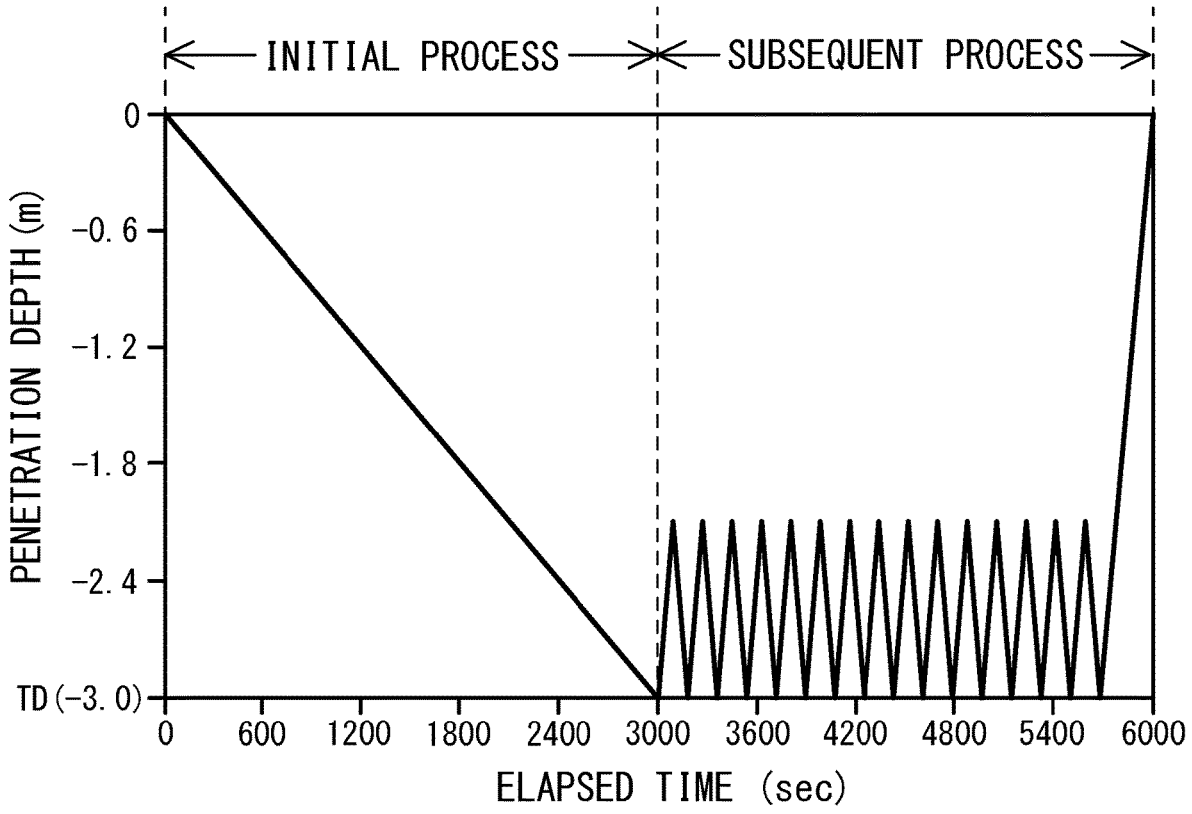
FIG. 8 is a graph illustrating temporal transition of a penetration depth of the stirring blades.

The horizontal axis of a graph of FIG. 8 indicates an elapsed time after the stirring blades 6 are caused to penetrate into the water bottom B, and the vertical axis of the graph indicates a penetration depth of the stirring blades 6 based on the surface of the water bottom B (0 m). As shown in the graph of FIG. 8, in this embodiment, in the initial process, the stirring blades 6 are caused to penetrate from the surface of the water bottom B in the undrilled state to the target depth TD. Then, in the subsequent process, the stirring blades 6 are reciprocated in the pipe axial direction within a predetermined depth range from the target depth TD up to the surface of the water bottom B (a range shallower than the target depth TD) inside the insertion pipe 3.

Figure 9:
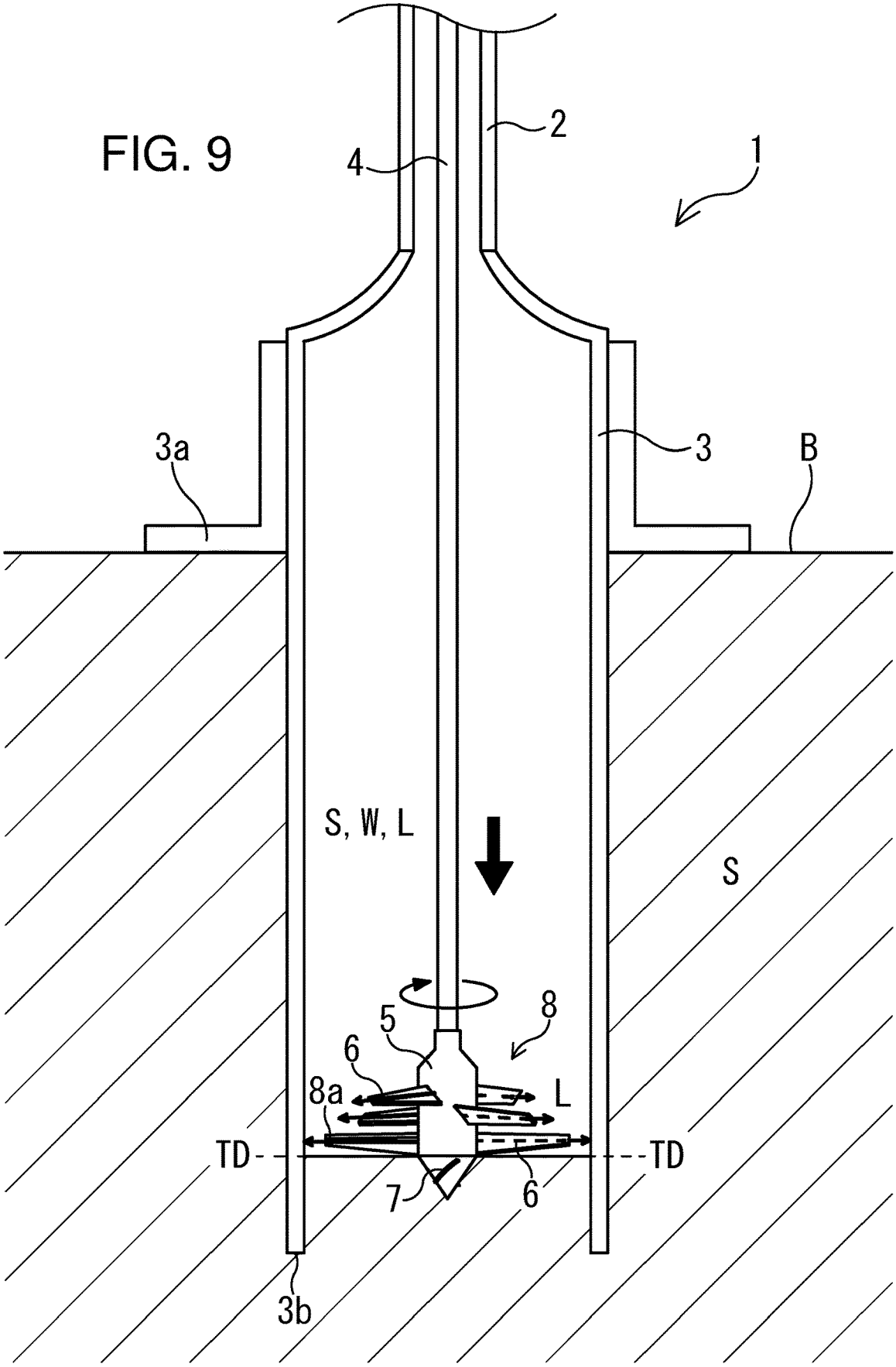
FIG. 9 is an explanatory diagram illustrating a state where the stirring blades being rotated at a lower speed are caused to penetrate into the target depth of the water bottom from the state of FIG. 5.

As illustrated in FIG. 9, when the stirring blades 6 having a rotation speed made lower are caused to penetrate from the surface of the water bottom B to the predetermined depth PD in the initial process, it is possible to further reduce the risk that the mud S having large soil masses rises to the upper portion of the insertion pipe 3 and the mining riser pipe 2 is clogged with the mud S.

Figure 10:
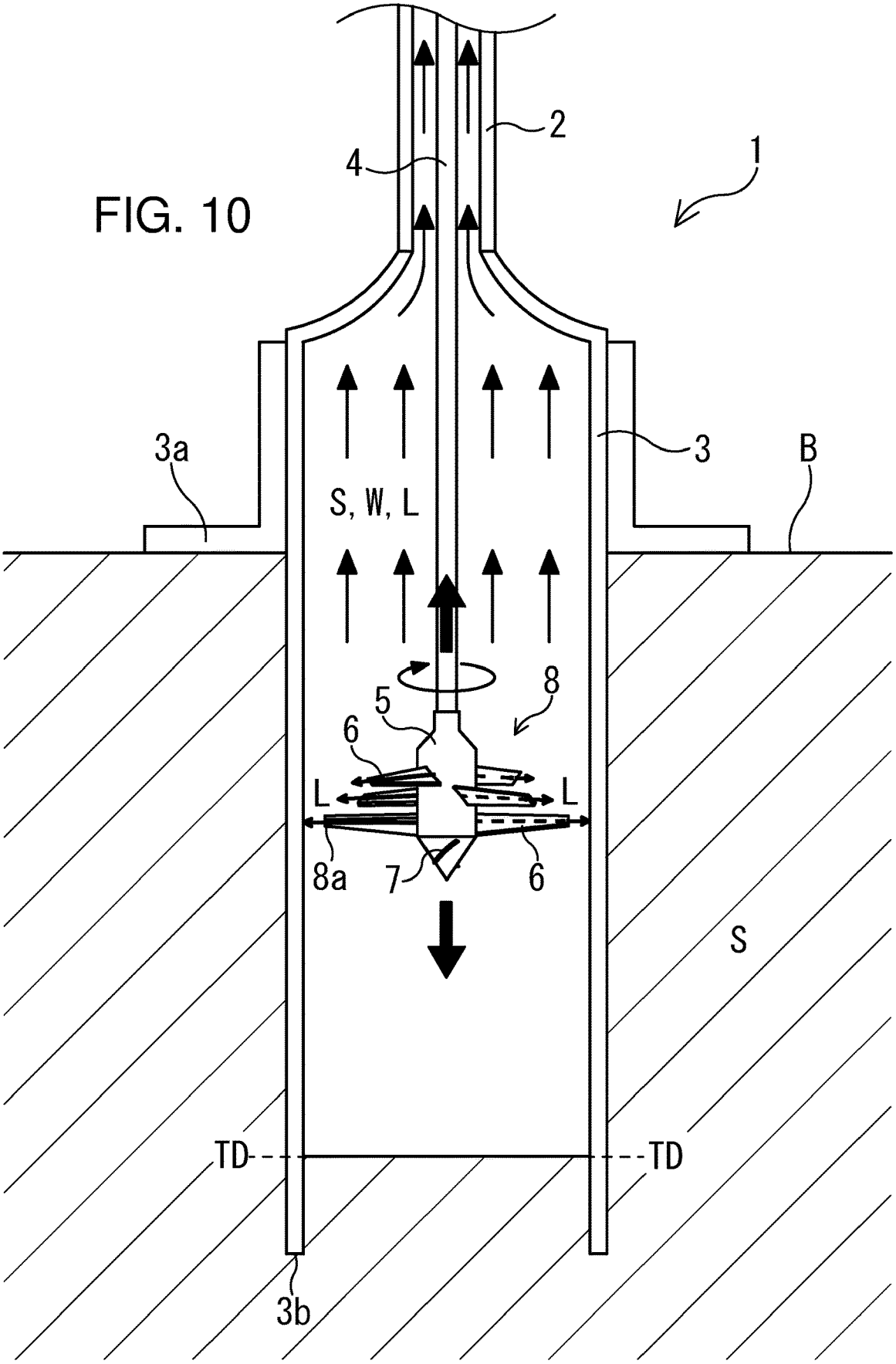
FIG. 10 is an explanatory diagram illustrating a state where the stirring blades being rotated at a higher speed are being reciprocated in a pipe axial direction inside the insertion pipe from the state of FIG. 9.

Then, as illustrated in FIG. 10, when the stirring blades 6 having a rotation speed made higher are reciprocated in the pipe axial direction within the predetermined depth range from the target depth TD up to the surface of the water bottom B inside the insertion pipe 3 to repeatedly dissolve the mud S inside the insertion pipe 3 in the subsequent process, the mud S inside the insertion pipe 3 can be more certainly broken into finer grains. Moreover, reciprocating the stirring blades 6 rotating at a high speed in the pipe axial direction makes the mud S dissolved inside the insertion pipe 3 more unlikely to sediment in the lower portion of the insertion pipe 3. Therefore, this is much more advantageous in efficiently lifting the mud S of the water bottom B with a relatively small amount of the liquid. It is preferable that the stirring blades 6 be moved from the target depth TD to the upper portion of the insertion pipe 3. The number of times the stirring blades 6 are reciprocated may be determined as appropriate in accordance with the hardness of the mud S of the water bottom B, the number of the stirring blades 6, and the like, but the stirring blades 6 may be reciprocated a plurality of times such as around 2 to 15 times, for example.

Although the rotation speed of stirring blades 6 may be set to be constant in each of the initial process and the subsequent process, for example, the rotation speed of the stirring blades 6 may be set to be higher as the penetration depth of the stirring blades 6 becomes deeper. When the rotation speed of the stirring blades 6 is set to be higher as the penetration depth becomes deeper, it is possible to more efficiently drill and dissolve the mud S while avoiding a situation that the mud S having large soil masses rises to the upper portion of the insertion pipe 3 and the mining riser pipe 2 is clogged with the mud S.

The speed of moving the stirring blades 6 in the pipe axial direction may be set as appropriate in accordance with the hardness of the mud S of the water bottom B and the like. Specifically, the speed of moving the stirring blades 6 in the pipe axial direction may be set, for example, within a range of 1 mm/sec to 100 mm/sec, and more preferably 1 mm/sec to 10 mm/sec. It is preferable that the speed of moving the stirring blades 6 in the pipe axial direction be set lower in the initial process than in the subsequent process.

In the initial process in which the stirring blades 6 are caused to penetrate into the water bottom B in the undrilled state, the load applied to the stirring blades 6 is also relatively large. Therefore, in the initial process, by setting the speed of moving the stirring blades 6 in the pipe axial direction to a relatively low speed of around 1 mm/sec to 5 mm/sec, it is possible to relatively finely dissolve the mud S of the water bottom B while avoiding a situation that an excessive load is applied to the stirring blades 6 even when the rotation speed of the stirring blades 6 is low. In the subsequent process, since the rotation speed of the stirring blades 6 is set to be higher than in the initial process, it is possible to efficiently drill and dissolve the mud S inside the insertion pipe 3 by setting the speed of moving the stirring blades 6 in the pipe axial direction to a speed higher than in the initial process. The speed of moving the stirring blades 6 in the pipe axial direction in the subsequent process may be set, for example, to around 5 mm/sec to 100 mm/sec, and more preferably around 5 mm/sec to 10 mm/sec.

When the liquid L is jetted from the jet nozzles 8*a* provided on the tip end portions of the stirring blades 6 toward the inner peripheral surface of the insertion pipe 3, it is possible to drill and dissolve the mud S between the tip ends of the stirring blades 6 and the inner peripheral surface of the insertion pipe 3, which the stirring blades 6 do not reach. Therefore, it becomes possible to exhaustively lift the mud S inside the insertion pipe 3. Moreover, the jetting pressure of the liquid L necessary for cutting the mud S between the tip ends of the stirring blades 6 and the inner peripheral surface of the insertion pipe 3 can be made relatively low by arranging the jet nozzle 8*a* in the tip end portion of the stirring blade 6 which is close to the inner peripheral surface of the insertion pipe 3.

In addition, since a flow of the liquid (the water W of the water area and the liquid L) is generated inside the insertion pipe 3 by the liquid L jetted from the jet nozzles 8*a* at high pressure, the mud S inside the insertion pipe 3 is more easily broken into finer grains, and the mud S is more unlikely to sediment in the lower portion of the insertion pipe 3. The mud S which adheres to and remains on the inner peripheral surface of the insertion pipe 3 after the lifting of the mud S inside the insertion pipe 3 is ended can also be further reduced. Hence, in the case where the operation of lifting the mud S is conducted several times at different positions at which the insertion pipe 3 is inserted, the resistance in inserting the insertion pipe 3 at a new position in the water bottom B does not increase, so that the insertion pipe 3 can be smoothly inserted. The work necessary for the maintenance of the insertion pipe 3 after the lifting operation is ended can also be reduced.

In the initial process, if the liquid L is rapidly supplied into the insertion pipe 3, the risk that the mud S having large soil masses rises to the upper portion of the insertion pipe 3 and the mining riser pipe 2 is clogged with the mud S relatively increases. Therefore, the amount per unit time of the liquid to be supplied into the insertion pipe 3 may be set to be smaller in the initial process than in the subsequent process. When the amount per unit time of the liquid to be supplied into the insertion pipe 3 is set to be larger in the subsequent process than in the initial process, this is advantageous in efficiently raising the dissolved mud S in the slurry form to the upper portion of the insertion pipe 3.

Figure 11:
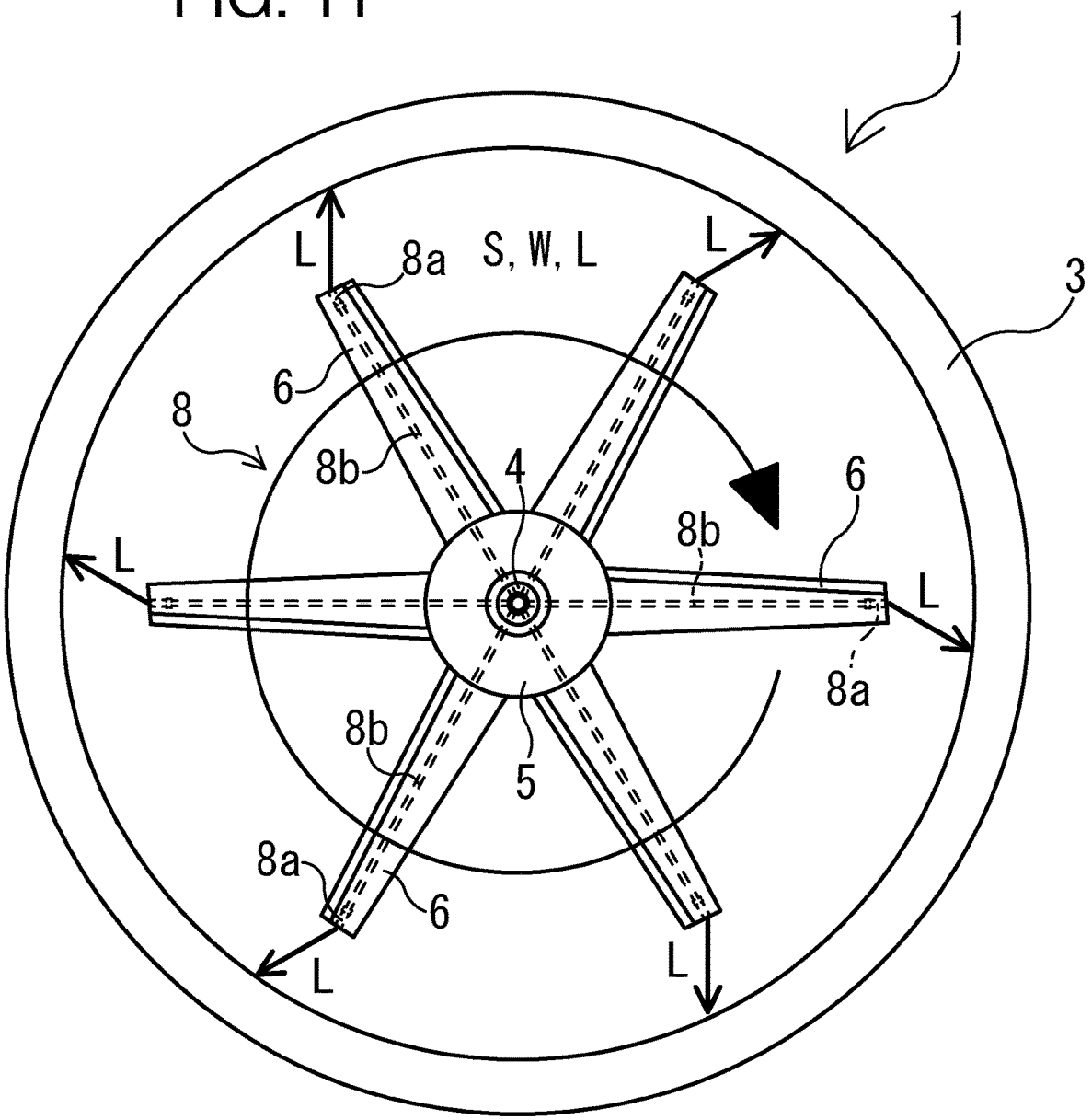
FIG. 11 is an explanatory diagram illustrating an inside of an insertion pipe in another embodiment of the water bottom resource collecting method of the present invention in plan view.

As in another embodiment of the present invention illustrated in FIG. 11, the liquid L may be jetted from jet nozzles 8*a* provided on tip end portions of stirring blades 6 obliquely frontward relative to the rotational direction of the stirring blades 6. The jetting angle of each jet nozzle 8*a* to the extension direction of the stirring blade 6 may be set as appropriate in accordance with the rotation speed of the stirring blades 6 and the like, but may be set, for example, within a range of 10 degrees to 45 degrees.

In this way, when the liquid L is jetted from the jet nozzles 8*a* obliquely frontward relative to the rotational direction of the stirring blades 6, the jetted liquid L can easily reach the inner peripheral surface of the insertion pipe 3 with greater force. Therefore, the mud S between the tip ends of the stirring blades 6 and the inner peripheral surface of the insertion pipe 3 can be more efficiently drilled and dissolved. For example, a configuration in which a variable mechanism that enables the jetting angle of each jet nozzle 8*a* relative to the extension direction of the stirring blade 6 to be changed may be provided, so that the jetting angle of each jet nozzle 8*a* is changed in accordance with the rotation speed of the stirring blades 6 is possible.

Figure 12:
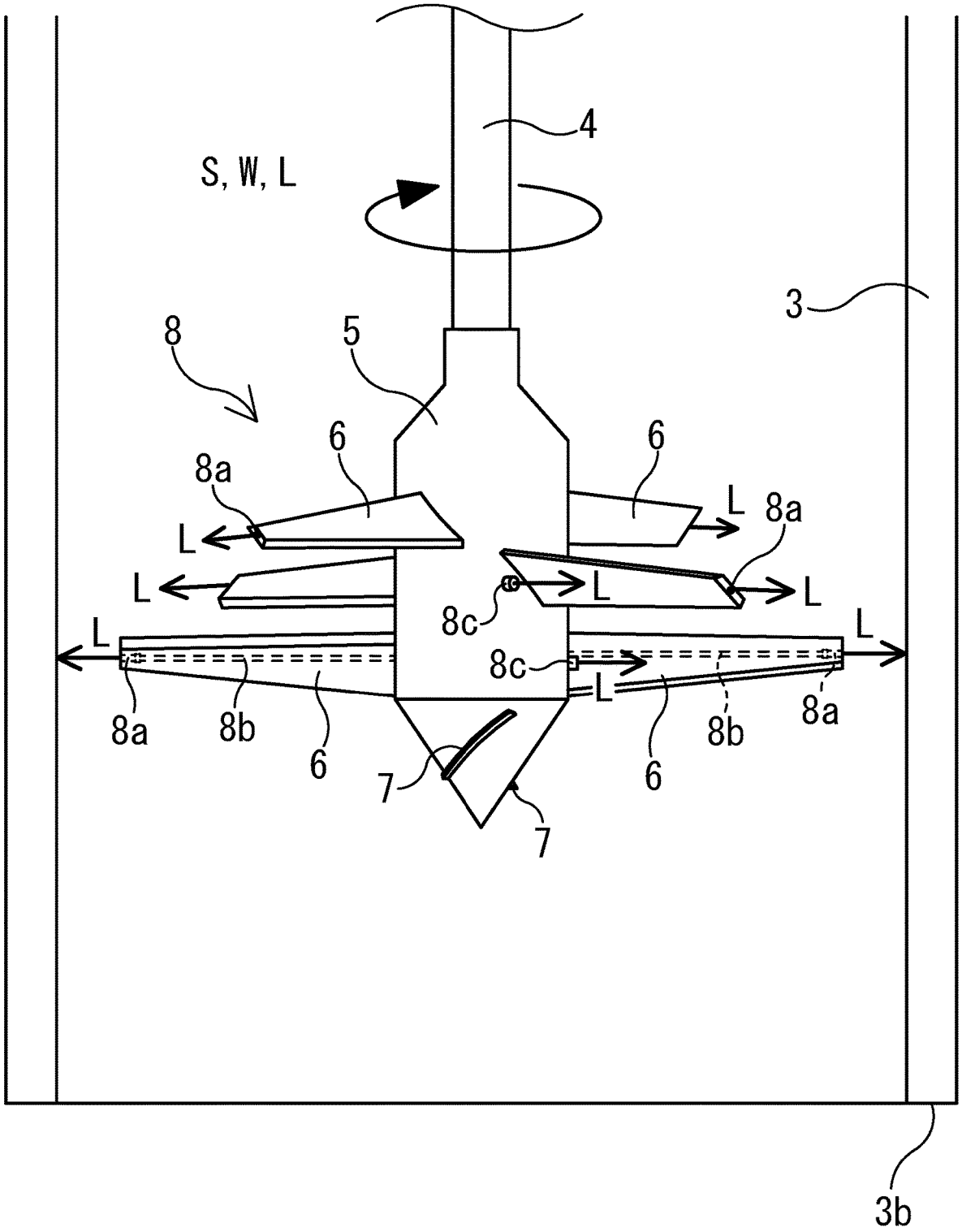
FIG. 12 is an explanatory diagram illustrating an inside of an insertion pipe in still another embodiment of the water bottom resource collecting method of the present invention in cross-sectional view.

As in still another embodiment of the present invention illustrated in FIG. 12, as the liquid supply mechanism 8, ejection nozzles 8*c* that eject the liquid L may be provided in the lower portion (the head 5) of the rotation shaft 4 disposed inside the insertion pipe 3. When the liquid L is ejected from the ejection nozzles 8*c* toward the surfaces of the stirring blades 6 in this way, the mud S which has adhered to the surfaces of the stirring blades 6 can be removed. Therefore, the mud S is prevented from being deposited on the surfaces of the stirring blades 6, and this becomes more advantageous in exhaustively lifting the mud S inside the insertion pipe 3. In addition, since the liquid L can more easily flow through the mud S within a range where the stirring blades 6 reach, the mud S can more easily flow inside the insertion pipe 3. Therefore, this becomes more advantageous in efficiently breaking the mud S inside the insertion pipe 3 into finer grains.

Next, still another example of the procedure of the method for collecting water bottom resources will be described below.

Figure 13:
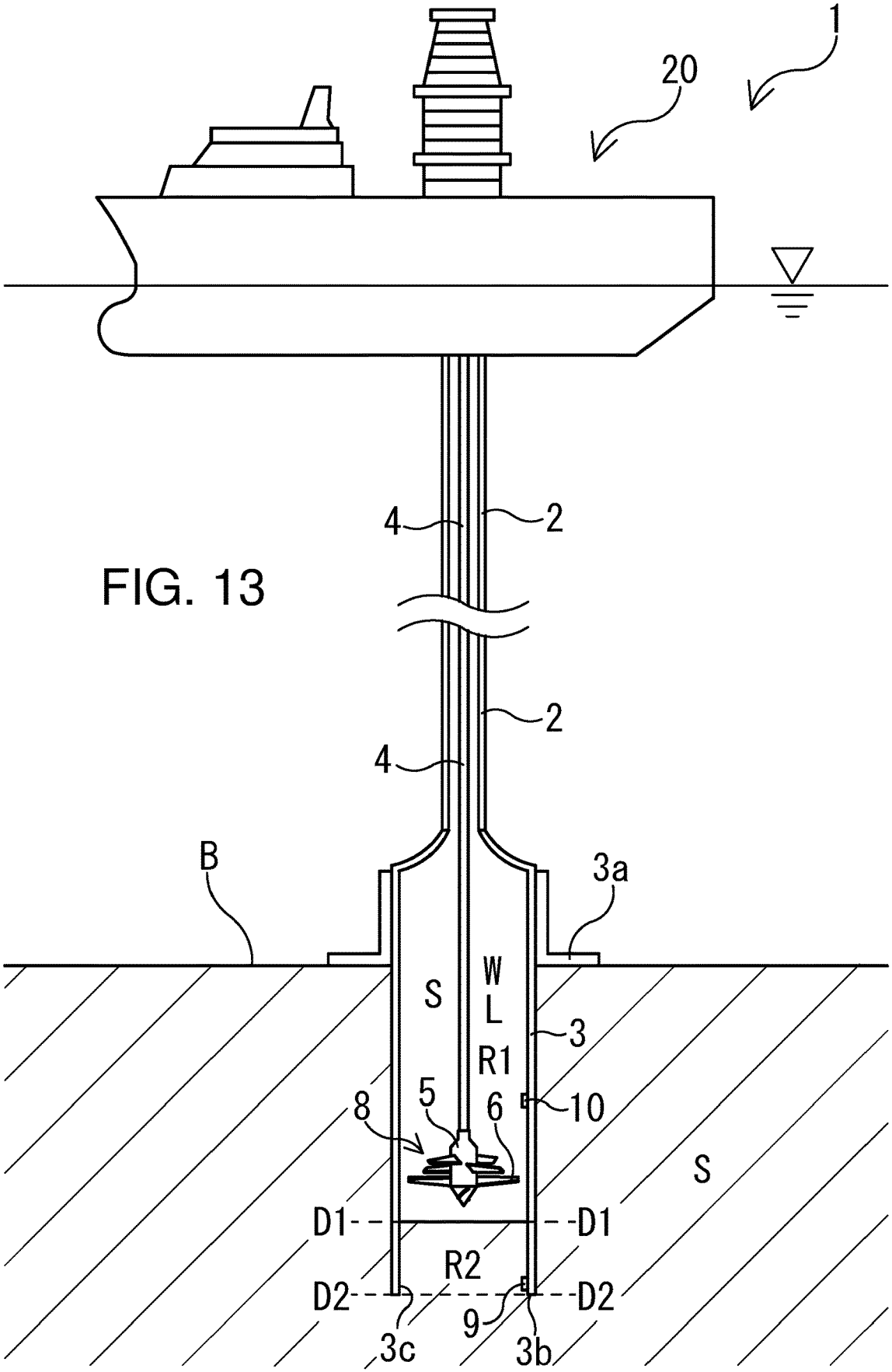
FIG. 13 is an explanatory diagram illustrating an outline of another embodiment of the water bottom resource collecting method of the present invention.
Figure 14:
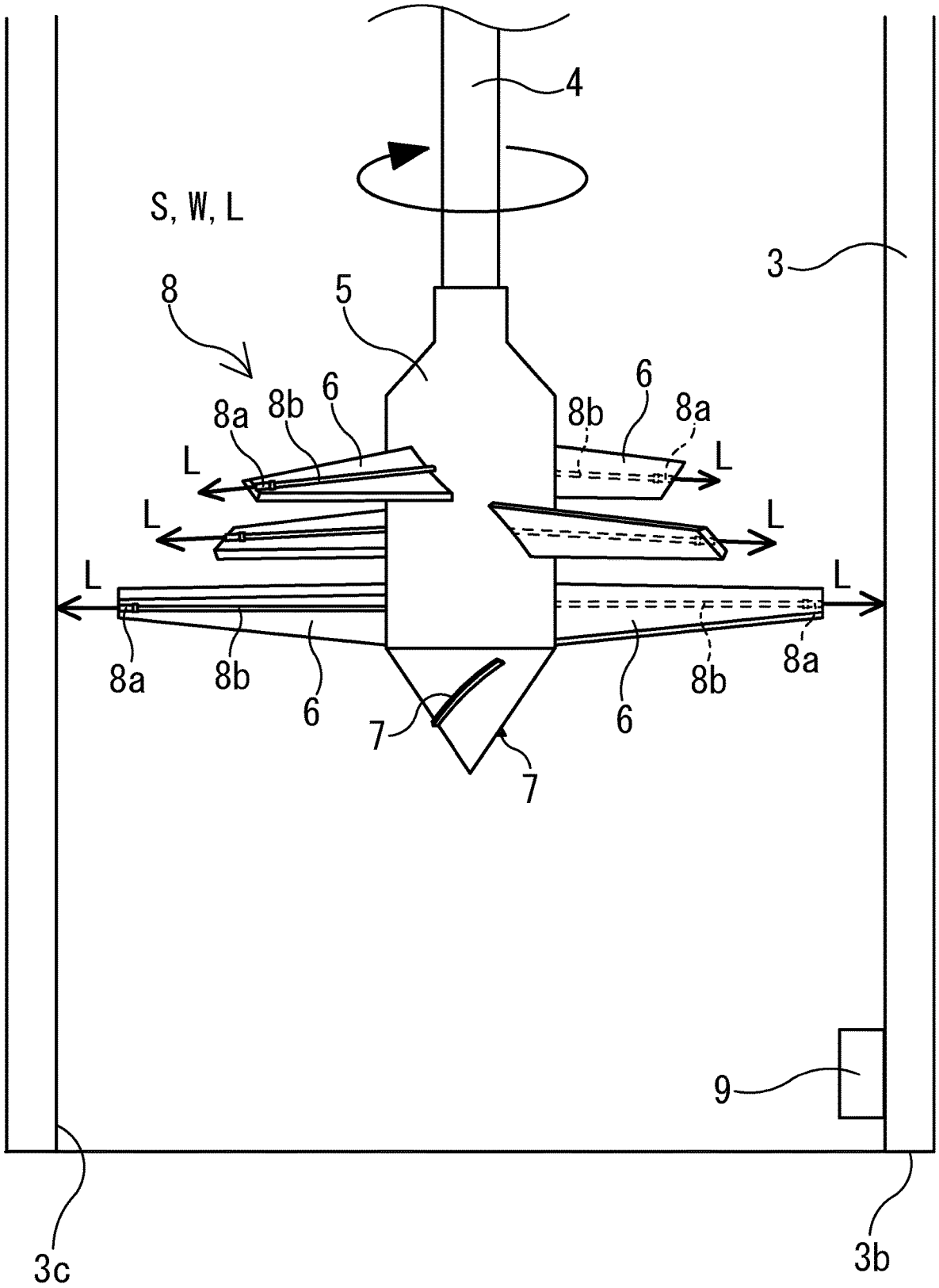
FIG. 14 is an explanatory diagram illustrating an inside of an insertion pipe of FIG. 13 in vertical cross-sectional view.

As illustrated in FIG. 13 and FIG. 14, a collecting system 1 used in this embodiment includes: a mining riser pipe 2 that extends from above water toward a water bottom B; an insertion pipe 3 that is connected to a lower portion of the mining riser pipe 2; and a rotation shaft 4 that extends inside the mining riser pipe 2 and the insertion pipe 3 in a pipe axial direction. The collecting system 1 further includes: stirring blades 6 that are attached to a lower portion of the rotation shaft 4; and a liquid supply mechanism 8 that supplies a liquid L into the insertion pipe 3. The collecting system 1 of this embodiment further includes: a strength sensor 9 and a pressure sensor 10 which are placed in the insertion pipe 3. The configurations of the mining riser pipe 2, the insertion pipe 3, the rotation shaft 4, the stirring blades 6, and the liquid supply mechanism 8 are the same as those in the embodiment illustrated before.

The strength sensor 9 measures the strength of the water bottom B in the undrilled state. The index indicating the strength of the water bottom B includes, for example, the uniaxial compressive strength, the N value, the cone index, and the like in the pipe axial direction of the mud S of the water bottom B. As the strength sensor 9, for example, a soil hardness tester, a soil strength probe, or the like is used. The strength sensor 9 is placed at a position in the insertion pipe 3 which is inserted into the water bottom B. The strength sensor 9 may be placed, for example, near a lower end opening 3*c* of the insertion pipe 3 (at a position where a separation distance from the lower end opening 3*c* in the pipe axial direction is within 30 cm). Although the strength sensor 9 is placed at a position in the inner peripheral surface of the insertion pipe 3 which does not come into contact with the stirring blades 6 in this embodiment, the strength sensor 9 may be placed, for example, on an outer peripheral surface or a lower end surface of the insertion pipe 3.

The pressure sensor 10 measures the pressure inside the insertion pipe 3 inserted into the water bottom B. The pressure sensor 10 is placed, for example, within a range serving as a drilling target region R1 where the mud S is drilled and dissolved by the stirring blades 6. The pressure sensor 10 may be placed, for example, at a position where a separation distance upward from a lower end 3*b* of the insertion pipe 3 is 100 cm or more and 500 cm or less. In this embodiment, the pressure sensor 10 is placed at a position in the inner peripheral surface of the insertion pipe 3 which does not come into contact with the stirring blades 6. The measurement data of each of the strength sensor 9 and the pressure sensor 10 is successively transmitted to an administration unit above the water (on the offshore vessel 20), so that an administrator can grasp the measurement data. Each of the strength sensor 9 and the pressure sensor 10 may be optionally provided.

Next, an example of the procedure of the method for collecting water bottom resources by using this collecting system 1 will be described below.

Figure 15:
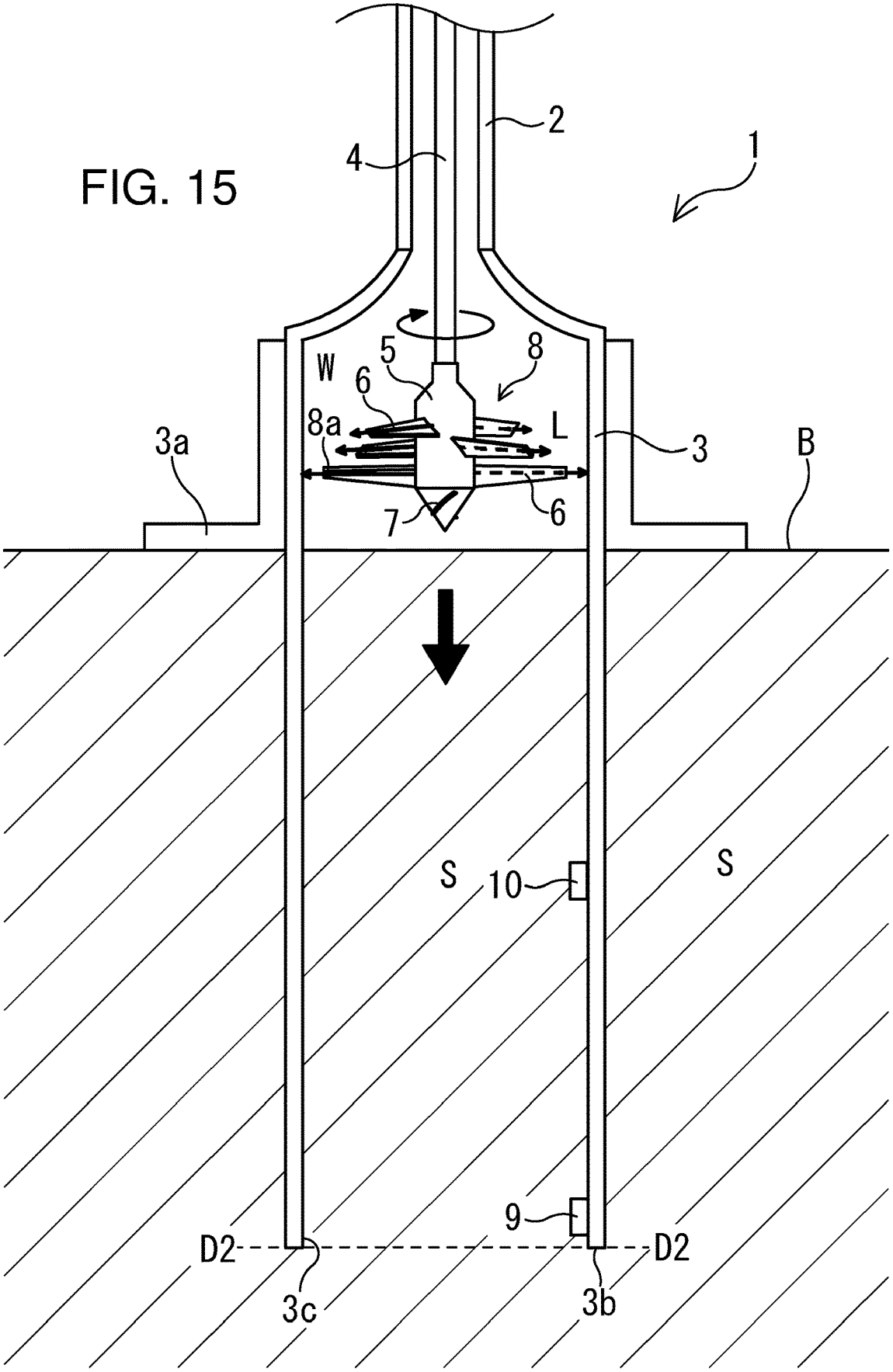
FIG. 15 is an explanatory diagram illustrating a state where the insertion pipe of FIG. 13 is inserted in a water bottom.

The insertion pipe 3 is connected to the lower portion of the mining riser pipe 2, and the head 5 is detachably fixed inside the upper portion of the insertion pipe 3. As illustrated in FIG. 15, the mining riser pipe 2 is extended from above the water (the offshore vessel 20) toward the water bottom B, and at least the lower portion of the insertion pipe 3 is inserted into the water bottom B in the undrilled state. The upper portion of the insertion pipe 3 in which the head 5 is housed is not inserted into the water bottom B, so that the head 5 is disposed above the surface of the water bottom B. The insertion pipe 3 is brought into a state where at least the lower portion of the insertion pipe 3 is inserted into the water bottom B and the upper portion of the insertion pipe 3 protrudes above the surface of the water bottom B. For example, 50% or more of the entire length of the insertion pipe 3 is inserted into the water bottom B.

At this stage, the inside of the lower portion of the insertion pipe 3, which is inserted in the water bottom B, is in the state of being filled with the mud S of the water bottom B in the undrilled state. The inside of the upper portion of the insertion pipe 3, which is not inserted in the water bottom B, is in the state of being filled with water W of the water area. In the course of inserting the insertion pipe 3 into the water bottom B, the strength of the water bottom B is successively measured by the strength sensor 9.

In this embodiment, when the insertion pipe 3 is inserted into the water bottom B to a position at which the stopper 3*a* provided on the outer side of the insertion pipe 3 abuts on the surface of the water bottom B, the lower portion of the insertion pipe 3 is inserted to a depth of the stratum where water bottom resources are distributed. The upper portion of the insertion pipe 3 in which the head 5 is housed is in the state of protruding above the surface of the water bottom B.

Subsequently, in the state of being inserted through the insides of the mining riser pipe 2 and the insertion pipe 3, the rotation shaft 4 is sent down from above the water (the offshore vessel 20) toward the water bottom B, and the head 5 (the stirring blades 6) is coupled to the lower end portion of the rotation shaft 4. In the state in which the head 5 is coupled to the lower end portion of the rotation shaft 4, when the rotation shaft 4 is further moved downward toward the water bottom B, the head 5 is detached from the insertion pipe 3. As a result, the head 5 (the stirring blades 6) integrated with the rotation shaft 4 is brought into the state of being capable of moving in the pipe axial direction.

Figure 16:
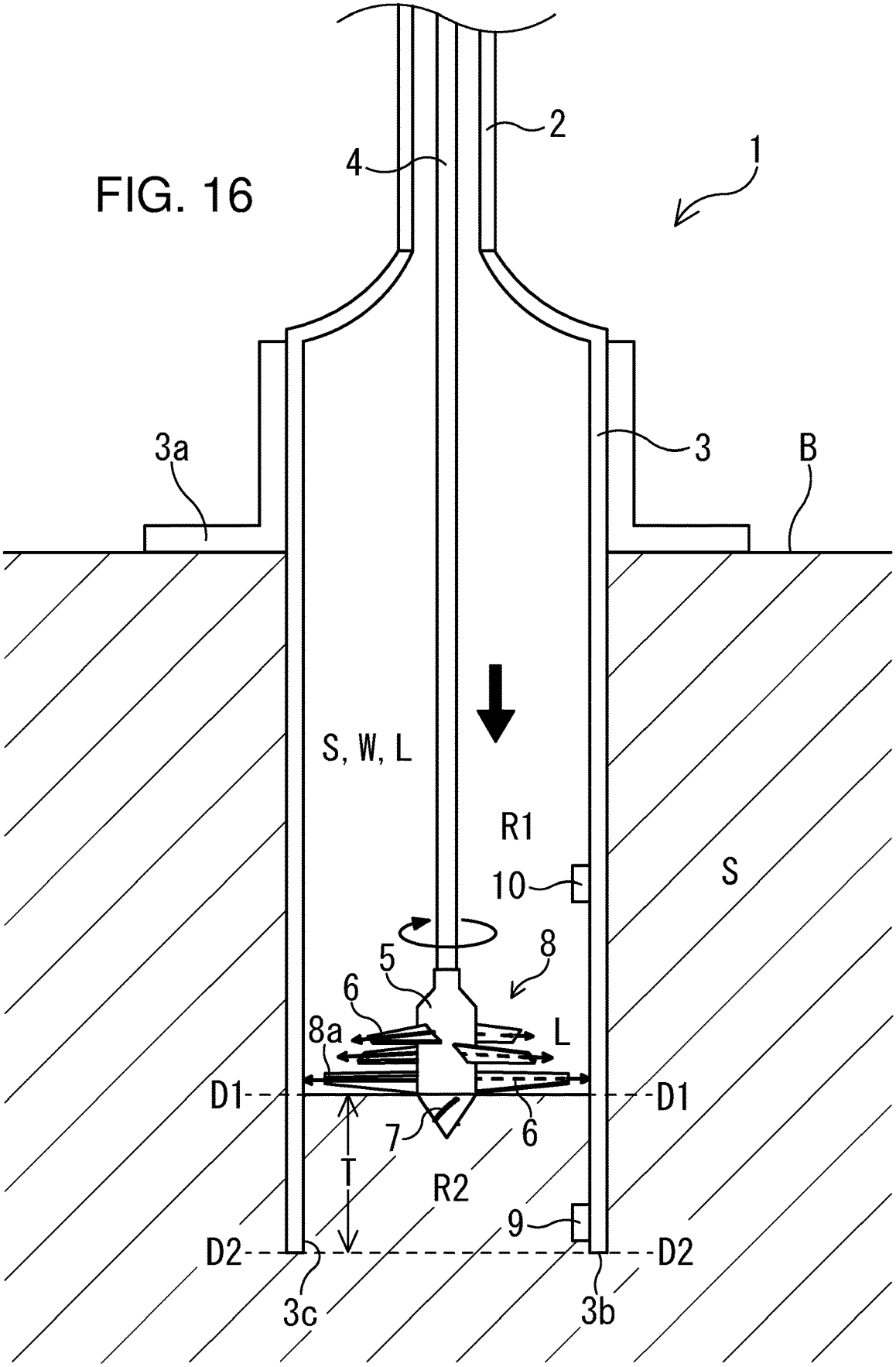
FIG. 16 is an explanatory diagram illustrating a state where stirring blades are caused to penetrate into a deepest penetration position of the water bottom from the state of FIG. 15.
Figure 17:
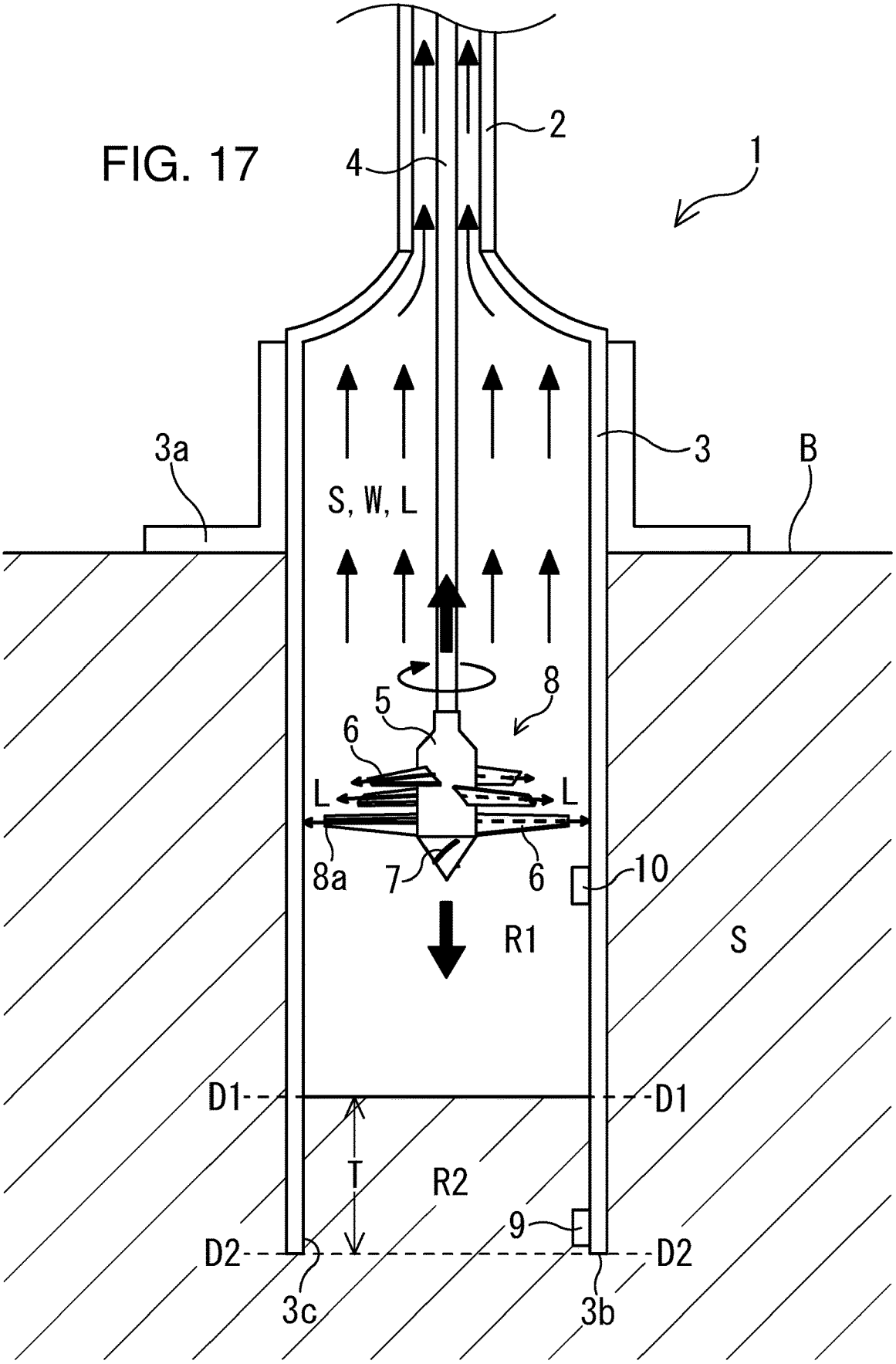
FIG. 17 is an explanatory diagram illustrating a state where the stirring blades are being reciprocated in a pipe axial direction inside the insertion pipe from the state of FIG. 16.

Subsequently, as illustrated in FIG. 16, the liquid L is supplied into the insertion pipe 3 by the liquid supply mechanism 8, and the rotation shaft 4 and the stirring blades 6 attached to the lower portion (the head 5) of the rotation shaft 4 are rotated inside the insertion pipe 3. Then, the stirring blades 6 being rotated are caused to penetrate from the surface of the water bottom B into the mud S of the water bottom B to drill the mud S inside the insertion pipe 3 and dissolve the mud S into a slurry form. In this embodiment, while the liquid L is supplied into the insertion pipe 3, the mud S between the tip ends of the stirring blades 6 and the inner peripheral surface of the insertion pipe 3 is drilled and dissolved, by jetting the liquid L from the jet nozzles 8*a* toward the inner peripheral surface of the insertion pipe 3 at high pressure. The pressure inside the insertion pipe 3 (hereinafter, referred to as an internal pressure of the insertion pipe 3) is successively measured by the pressure sensor 10.

When the stirring blades 6 are caused to penetrate into the water bottom B, the deepest penetration position D1 of the stirring blades 6 (the stirring blades 6 located at the lowest positions) is set at a predetermined distance T upward from the lower end 3*b* of the insertion pipe 3. Then, the lower end opening 3*c* of the insertion pipe 3 is maintained in the state of being blocked by the mud S of the water bottom B to prevent the mud S dissolved into the slurry form by the stirring blades 6 from flowing out of the insertion pipe 3 through the lower end opening 3*c* of the insertion pipe 3.

That is, the mud S in the drilling target region R1 from the surface of the water bottom B to the deepest penetration position D1 inside the insertion pipe 3 is drilled and dissolved by the stirring blades 6, and a non-drilled region R2 having a thickness of the predetermined distance T in the pipe axial direction is left to remain between the deepest penetration position D1 and a depth D2 at which the lower end 3*b* of the insertion pipe 3 is located. Then, the lower end opening 3*c* of the insertion pipe 3 is brought into the state of being stuffed and blocked with the mud S in the non-drilled region R2 which is harder than the dissolved mud S. In the drawings, the mud S which has not been drilled is indicated by oblique hatching.

The aforementioned predetermined distance T is set to a distance that can prevent the mud S in the non-drilled region R2 which blocks the lower end opening 3*c* of the insertion pipe 3 from being collapsed by the internal pressure of the insertion pipe 3 even in the case where the internal pressure of the insertion pipe 3 is maximized while the mud S inside the insertion pipe 3 is drilled and dissolved by the stirring blades 6. The resistance of the mud S in the non-drilled region R2 against the internal pressure of the insertion pipe 3 increases as the strength of the water bottom B (for example, the uniaxial compressive strength, the N value, the cone index, or the like) or the predetermined distance T increases.

Therefore, an appropriate predetermined distance T without excess or deficiency which can prevent the mud S which blocks the lower end opening 3*c* of the insertion pipe 3 from being collapsed by the internal pressure of the insertion pipe 3 can be set based on the strength of the water bottom B and the internal pressure of the insertion pipe 3. By setting the predetermined distance T, the deepest penetration position D1 to which the stirring blades 6 are caused to penetrate can also be set from the relation with the depth D2 at which the lower end 3*b* of the insertion pipe 3 is located.

The strength of the water bottom B can be acquired by the strength sensor 9 when the insertion pipe 3 is inserted into the water bottom B as in this embodiment, or can be acquired in advance before the insertion pipe 3 is inserted into the water bottom B. Alternatively, the strength of the water bottom B can be acquired both before and when the insertion pipe 3 is inserted into the water bottom B.

In the case where the strength of the water bottom B is acquired in advance, for example, a known strength test that collects the mud S of the water bottom B in the undrilled state and measures the strength of the water bottom B (for example, the uniaxial compressive test, the standard penetration test, or the like) is conducted. As in this embodiment, providing the strength sensor 9 makes it possible to measure the strength of the water bottom B by using the strength sensor 9 when the insertion pipe 3 is inserted into the water bottom B.

In the case where the strength of the water bottom B is measured both before and when the insertion pipe 3 is inserted into the water bottom B, the predetermined distance T may be set by employing a lower measured value of the strength of the water bottom B. This makes it possible to more certainly prevent the mud S which blocks the lower end opening 3*c* of the insertion pipe 3 from being collapsed by the internal pressure of the insertion pipe 3 than the case where the predetermined distance T is set based on one measured value before or when the insertion pipe 3 is inserted into the water bottom B.

The internal pressure of the insertion pipe 3 inserted into the water bottom B can be acquired by the pressure sensor 10 after the insertion pipe 3 is inserted into the water bottom B as in this embodiment, or can be acquired in advance before the insertion pipe 3 is inserted into the water bottom B. Alternatively, the internal pressure of the insertion pipe 3 can be acquired both before and after the insertion pipe 3 is inserted into the water bottom B.

The internal pressure of the insertion pipe 3 inserted into the water bottom B can be calculated in advance based on conditions such as the dimensions of the insertion pipe 3, the amount per unit time of the liquid to be supplied into the insertion pipe 3, and the lifted amount per unit time by the lifting means. The internal pressure of the insertion pipe 3 can also be acquired in advance by conducting a preliminary test using the collecting system 1 or a simulation using a computer. For example, in a preliminary test, the internal pressure of the insertion pipe 3 in the drilling target region R1 while the mud S inside the insertion pipe 3 is drilled and dissolved by the stirring blades 6 while the liquid L is supplied into the insertion pipe 3 inserted into the water bottom B is measured by the pressure sensor 10.

Providing the pressure sensor 10 as in this embodiment makes it possible to measure the internal pressure of the insertion pipe 3 in the drilling target region R1 where the stirring blades 6 are caused to penetrate, in the course of causing the stirring blades 6 to penetrate into the water bottom B after the insertion pipe 3 is inserted into the water bottom B, by using the pressure sensor 10. Then, the predetermined distance T can be set by using the measured value of the internal pressure of the insertion pipe 3 acquired by the pressure sensor 10 in the course of causing the stirring blades 6 to penetrate.

While the mud S is drilled and dissolved, if a condition such as the rotation speed or movement speed of the stirring blades 6, the amount per unit time of the liquid to be supplied into the insertion pipe 3, or the lifted amount per unit time by the lifting means is changed, the internal pressure of the insertion pipe 3 varies to some extent along with the change. Hence, the predetermined distance T may be set based on the maximum value of the internal pressure of the insertion pipe 3 during drilling and dissolving.

In the case where the internal pressure of the insertion pipe 3 is acquired both before and after the insertion pipe 3 is inserted into the water bottom B, the predetermined distance T may be set by employing a higher measured value of the maximum value of the internal pressure of the insertion pipe 3. This makes it possible to more certainly prevent the mud S which blocks the lower end opening 3*c* of the insertion pipe 3 from being collapsed by the internal pressure of the insertion pipe 3 than the case where the predetermined distance T is set based on one measured value before or after the insertion pipe 3 is inserted into the water bottom B.

After the stirring blades 6 are caused to penetrate to the deepest penetration position D1, as illustrated in FIG. 7, the stirring blades 6 are reciprocated in the pipe axial direction within a predetermined depth range from the deepest penetration position D1 up to the surface of the water bottom B (a range shallower than the deepest penetration position D1), thereby repeatedly dissolving the mud S in the drilling target region R1. The number of times the stirring blades 6 are reciprocated may be determined as appropriate in accordance with the strength of the water bottom B, the number of the stirring blades 6, the rotation speed of the stirring blades 6, and the like, but the stirring blades 6 may be reciprocated a plurality of times such as around 2 to 15 times, for example. Although this operation of reciprocating the stirring blades 6 may be omitted as appropriate, conducting this operation makes it possible to more certainly break the mud S in the drilling target region R1 into finer grains.

The mud S in the drilling target region R1 which has been broken into finer grains inside the insertion pipe 3 is mixed with and floated in the liquid inside the insertion pipe 3 (including the water W of the water area and the liquid L supplied by the liquid supply mechanism 8), and the inside of the insertion pipe 3 above the deepest penetration position D1 is filled with the mud S in the slurry form. Then, the mud S in the drilling target region R1 which has been turned into the slurry form by the dissolving is raised to an upper portion of the insertion pipe 3, and the raised mud S in the slurry form is lifted above the water (on the offshore vessel 20) through the mining riser pipe 2 by the lifting means.

By newly supplying the liquid L into the insertion pipe 3 by the liquid supply mechanism 8 (the jet nozzles 8*a*), the replacement of the water W and the mud S in the drilling target region R1 inside the insertion pipe 3 with the newly supplied liquid L is promoted. Moreover, the stirring flow is generated inside the insertion pipe 3 by the rotation of the stirring blades 6, and thus allows the mud S broken into finer grains inside the insertion pipe 3 to easily rise to the upper portion of the insertion pipe 3, and to be efficiently lifted above the water.

In this way, in this collecting method, the liquid L is supplied into the insertion pipe 3 inserted in the water bottom B and the stirring blades 6 are rotated, thereby drilling and dissolving the mud S inside the insertion pipe 3. Moreover, the deepest penetration position D1 of the stirring blades 6 is set at the predetermined distance T upward from the lower end 3*b* of the insertion pipe 3, and the lower end opening 3*c* of the insertion pipe 3 is brought into the state of being blocked by the mud S of the water bottom B to prevent the mud S dissolved into the slurry form from flowing out of the insertion pipe 3 through the lower end opening 3*c* of the insertion pipe 3. This makes it possible to effectively break the mud S inside the insertion pipe 3 into finer grains in a slurry form with a relatively small amount of the liquid, and to efficiently raise the mud S in the slurry form to the upper portion of the insertion pipe 3 by avoiding a waste of the mud S in the slurry form due to flowing out. Therefore, water bottom resources contained in the mud S of the water bottom B can be efficiently collected. It is also possible to prevent the state of the mud S around the outer periphery of the insertion pipe 3 from being disturbed, by preventing the dissolved mud S from flowing out. In the case where a liquid other than water is supplied as the liquid L as well, since it is possible to prevent the liquid L from flowing out into the water outside the insertion pipe 3, the risk of damaging the underwater environment can also be significantly reduced.

Seemingly, it can be considered that a larger amount of water bottom resources can be collected by causing the stirring blades 6 to penetrate as deeply as possible with the predetermined distance T being set to substantially zero to dissolve the mud S. However, the strength of the mud S of the water bottom B that contains water bottom resources such as rare earths is relatively low, and also the water depth is high, so that there are many uncertainties. Hence, in the case where the stirring blades 6 are caused to penetrate to the lower end 3*b* of the insertion pipe 3, the risk that the dissolved mud S and the supplied liquid L inside the insertion pipe 3 flow out of the insertion pipe 3 through the lower end opening 3*c* of the insertion pipe 3 significantly increases. Once such flow out occurs, the mud S in the slurry form dissipates and the internal pressure of the insertion pipe 3 rapidly decreases. Therefore, the efficiency of lifting the mud S decreases. The present invention is a method that is capable of effectively and stably improving the efficiency of lifting the mud S with such simpleness that the non-drilled region R2 having a thickness of the predetermined distance T is intentionally left to remain in the lower portion of the insertion pipe 3. Therefore, this method is very useful for a person skilled in the art.

In addition, although the inner diameter of the mining riser pipe 2 used in the deep sea is small and the gap between the inner peripheral surface of the mining riser pipe 2 and the rotation shaft 4 is relatively narrow, the mud S inside the insertion pipe 3 flows into the mining riser pipe 2 in the state of being broken into finer grains with a small amount of soil mass, so that the mining riser pipe 2 is unlikely to be clogged with the mud S. Therefore, failure is unlikely to occur in the mining riser pipe 2, so that the mud S of the water bottom B can be very smoothly lifted.

Figure 18:
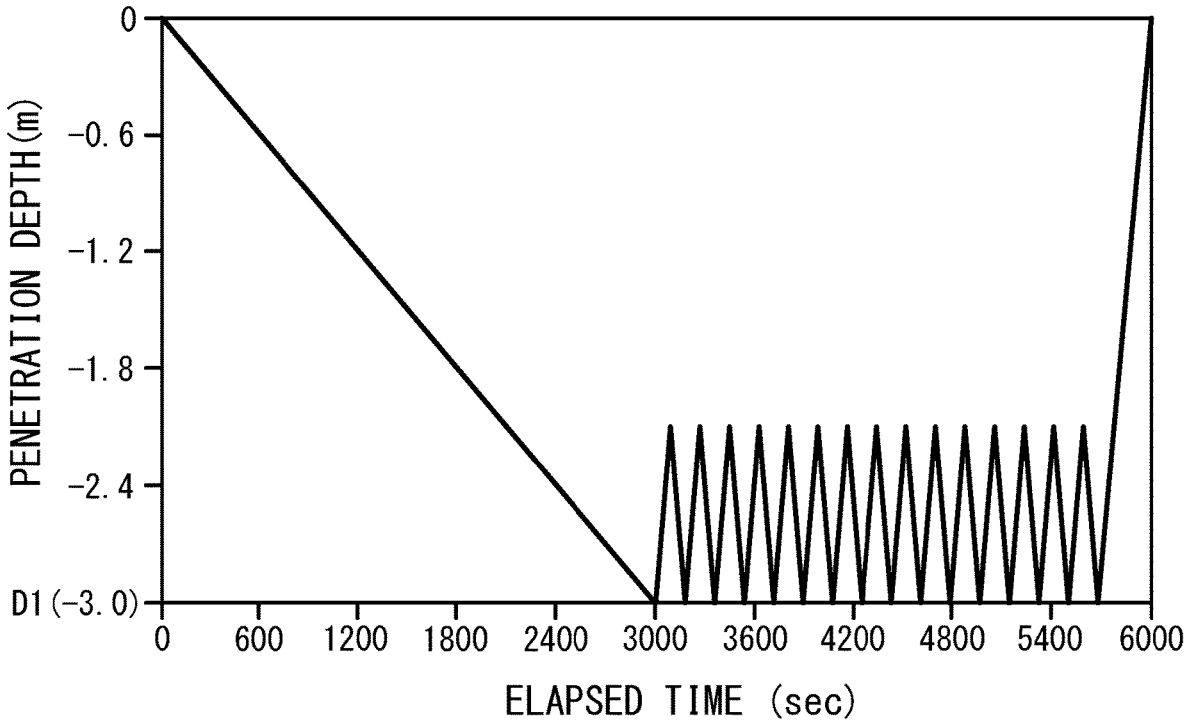
FIG. 18 is a graph illustrating temporal transition of a penetration depth of the stirring blades.

To efficiently dissolve the mud S and generate an effective stirring flow, the rotation speed of the stirring blades 6 may be set to 20 rpm or more, and more preferably 40 rpm or more. Particularly, to generate stirring flow which raises the mud S, it is necessary to make the rotation speed of the stirring blades 6 high to a certain degree. On the other hand, since there is a limitation on rotating the stirring blades 6 at a high speed, the upper limit of the rotation speed is set, for example, to 80 rpm, or around 60 rpm. The speed of moving the stirring blades 6 in the pipe axial direction may be set as appropriate in accordance with the strength of the mud S of the water bottom B and the like. Specifically, the speed of moving the stirring blades 6 in the pipe axial direction may be set within a range of, for example, 1 mm/sec to 100 mm/sec, and more preferably 1 mm/sec to 10 mm/sec. The horizontal axis of a graph of FIG. 18 indicates an elapsed time after the stirring blades 6 are caused to penetrate into the water bottom B, and the vertical axis thereof indicates a penetration depth of the stirring blades 6 based on the surface of the water bottom B (0 m). As shown in a graph of FIG. 18, the speed of moving the stirring blades 6 in the pipe axial direction at the time of reciprocating the stirring blades 6 inside the insertion pipe 3 in the pipe axial direction after the penetration may be set to be higher than the speed of moving the stirring blades 6 in the pipe axial direction at the time of causing the stirring blades 6 to penetrate from the surface of the water bottom B to the deepest penetration position D1.

At the time of causing the stirring blades 6 to penetrate into the water bottom B in the undrilled state, the mud S of the water bottom B has not been dissolved, and the load applied to the stirring blades 6 is relatively large. In this case, it is possible to avoid a situation in which an excessive load is applied to the stirring blades 6, by setting the speed of moving the stirring blades 6 in the pipe axial direction to a lower speed and causing the stirring blades 6 to penetrate. The mud S drilled once is in the state of being dissolved to a certain degree, and the load applied to the stirring blades 6 becomes relatively small. Therefore, after the stirring blades 6 are caused to penetrate to the deepest penetration position D1, the mud S inside the insertion pipe 3 can be efficiently dissolved by reciprocating the stirring blades 6 while setting the speed of moving the stirring blades 6 in the pipe axial direction to a higher speed.

When the configuration in which each of the stirring blades 6 included in the stirring blade group at the lowermost stage is inclined downward toward the rotational direction is employed, the mud S drilled and dissolved by the stirring blades 6 included in the stirring blade group at the lowermost stage rises upward, and is further dissolved by the stirring blades 6 included in the stirring blade groups at the upper stages. Therefore, the mud S can be very efficiently broken into finer grains. Moreover, since downward pressure generated by the mud S and the liquid (including water W of the water area and the liquid L) stirred by the stirring blades 6 included in the stirring blade group at the lowermost stage becomes relatively small, this becomes advantageous in preventing the mud S in the non-drilled region R2, which blocks the lower end opening 3*c* of the insertion pipe 3, from being collapsed.

In the case where the pressure sensor 10 is provided as in this embodiment, the amount per unit time of the liquid to be supplied into the insertion pipe 3 may be adjusted based on the measured value of the pressure sensor 10, in the step of reciprocating the stirring blades 6 in the pipe axial direction after the stirring blades 6 are caused to penetrate to the deepest penetration position D1. As the amount per unit time of the liquid to be supplied into the insertion pipe 3 is increased, the dissolved mud S more easily rises to the upper portion of the insertion pipe 3, and this becomes advantageous in enhancing the lifting efficiency. On the other hand, when the amount of the liquid to be supplied into the insertion pipe 3 becomes excessive relative to the lifted amount of the mud S and the liquid (including the water W of the water area and the liquid L), there is a possibility that the internal pressure of the insertion pipe 3 becomes larger than the maximum value of the internal pressure of the insertion pipe 3 that has been used in setting the predetermined distance T. Hence, the amount per unit time of the liquid to be supplied into the insertion pipe 3 may be adjusted to enhance the lifting efficiency as much as possible to such an extent that the internal pressure of the insertion pipe 3 does not exceed the maximum value of the internal pressure of the insertion pipe 3 used in setting the predetermined distance T based on the measured value of the pressure sensor 10.

Note that the method for setting the predetermined distance T is not limited to the method illustrated above as long as the predetermined distance T that allows the lower end opening 3*c* of the insertion pipe 3 to be maintained in the state of being blocked by the mud S in the non-drilled region R2 of the water bottom B against the internal pressure of the insertion pipe 3 can be set. For example, it is possible to conduct a preliminary test using the collecting system 1 or a simulation using a computer several times with different conditions for the predetermined distance T, and to set an appropriate predetermined distance T based on the test results.

The method described above with reference to FIG. 1 to FIG. 12 and the method described later with reference to FIG. 13 to FIG. 18 may be combined as appropriate. For example, in the method described above, it is possible to set the deepest penetration position D1 of the stirring blades 6 at the predetermined distance T upward from the lower end 3*b* of the insertion pipe 3, and maintain the lower end opening 3*c* of the insertion pipe 3 in the state of being blocked by the mud S of the water bottom B to prevent the mud S in the slurry form from flowing out of the insertion pipe 3 through the lower end opening 3*c* as in the method described later, or it is also possible to collect water bottom resources without employing the method described later. In addition, for example, in the method described later, it is possible to employ a configuration in which the rotation speed of the stirring blades 6 is set to be lower in the initial process at the early stage of drilling than in the subsequent process after the initial process as in the method described above, or it is also possible to collect water bottom resources without employing the method described above.

EXPLANATION OF REFERENCE NUMERALS

1 water bottom resource collecting system
2 mining riser pipe
3 insertion pipe
3*a* stopper
3*b* lower end
3*c* lower end opening
4 rotation shaft
5 head
6 stirring blade
7 drill blade
8 liquid supply mechanism
8*a* jet nozzle
8*b* pipe
8*c* ejection nozzle
9 strength sensor
10 pressure sensor
20 offshore vessel
B water bottom
PD predetermined depth
TD target depth
D1 deepest penetration position
D2 depth at which the lower end of the insertion pipe is located
R1 drilling target region
R2 non-drilled region
S mud
L liquid
W water

The invention claimed is:

1. A water bottom resource collecting method for drilling mud of a water bottom in an undrilled state which contains water bottom resources and lifting the mud above a surface of water covering the water bottom, the water bottom resource collecting method comprising:

in a state where a mining riser pipe is extended from above the water toward the water bottom and at least a lower portion of an insertion pipe connected to a lower portion of the mining riser pipe is inserted in the water bottom, supplying a liquid into the insertion pipe and rotating a rotation shaft that extends inside the mining riser pipe and the insertion pipe in a pipe axial direction and a stirring blade attached to a lower portion of the rotation shaft inside the insertion pipe, thereby drilling and dissolving the mud into a slurry form inside the insertion pipe by using the stirring blade;

raising the slurry form mud to an upper portion of the insertion pipe by using a stirring flow generated by the rotation of the stirring blade; and lifting the raised slurry form mud above the water surface through the mining riser pipe by using a pump, wherein a rotation speed of the stirring blade is lower in an initial process at an early stage of drilling than in a subsequent process after the initial process, the liquid is jetted from a jet nozzle provided on a tip end portion of the stirring blade obliquely frontward relative to a rotational direction of the stirring blade toward an inner peripheral surface of the insertion pipe, and the liquid is jetted from an ejection nozzle provided in the rotation shaft toward a surface of the stirring blade.

2. The water bottom resource collecting method according to claim 1, wherein in the initial process, the stirring blade is caused to penetrate from a surface of the water bottom to a predetermined depth that is shallower than a target depth, and in the subsequent process, the stirring blade is caused to penetrate from the predetermined depth to the target depth.

3. The water bottom resource collecting method according to claim 1, wherein in the initial process, the stirring blade is caused to penetrate from a surface of the water bottom to a target depth, and in the subsequent process, the stirring blade is reciprocated in the pipe axial direction within a predetermined depth range from the target depth up to the surface of the water bottom.

4. The water bottom resource collecting method according to claim 1, wherein an amount per unit time of the liquid to be supplied into the insertion pipe is made smaller in the initial process than in the subsequent process.

5. The water bottom resource collecting method according to claim 1, wherein a deepest penetration position of the stirring blade is set at a predetermined distance upward from a lower end of the insertion pipe, and a lower end opening of the insertion pipe is maintained in a state of being blocked by the mud of the water bottom, to prevent the slurry form mud from flowing out of the insertion pipe through the lower end opening.

6. The water bottom resource collecting method according to claim 5, wherein the predetermined distance is set based on a strength of the water bottom and a pressure inside the insertion pipe inserted in the water bottom.

7. The water bottom resource collecting method according to claim 6, wherein the strength is acquired in advance before the insertion pipe is inserted into the water bottom.

8. The water bottom resource collecting method according to claim 6, wherein the strength is acquired by using a strength sensor when the insertion pipe is inserted into the water bottom.

9. The water bottom resource collecting method according to claim 6, wherein the pressure is calculated and acquired in advance before the insertion pipe is inserted into the water bottom.

10. The water bottom resource collecting method according to claim 6, wherein the pressure is acquired by using a pressure sensor after the insertion pipe is inserted into the water bottom.

* * * * *